US011857885B2

(12) United States Patent
Kaburagi

(10) Patent No.: US 11,857,885 B2
(45) Date of Patent: Jan. 2, 2024

(54) CUBIC PUZZLE

(71) Applicant: CABU LLC, Tokyo (JP)

(72) Inventor: Takashi Kaburagi, Tokyo (JP)

(73) Assignee: CABU LLC, Tokyo (JP)

( * ) Notice: Subject to any disclaimer, the term of this patent is extended or adjusted under 35 U.S.C. 154(b) by 200 days.

(21) Appl. No.: 17/627,950

(22) PCT Filed: Jul. 26, 2019

(86) PCT No.: PCT/JP2019/029501
§ 371 (c)(1),
(2) Date: Jan. 18, 2022

(87) PCT Pub. No.: WO2021/019619
PCT Pub. Date: Feb. 4, 2021

(65) Prior Publication Data
US 2022/0288486 A1 Sep. 15, 2022

(51) Int. Cl.
*A63F 9/08* (2006.01)

(52) U.S. Cl.
CPC ..... *A63F 9/0842* (2013.01)

(58) Field of Classification Search
None
See application file for complete search history.

(56) References Cited

FOREIGN PATENT DOCUMENTS

JP 2002-528240 9/2002

OTHER PUBLICATIONS

Human Controller, "Self Solving Rubik's Cube", [online], Sep. 17, 2018, DMM.com LLC, DMM.make, [Retrieved on Oct. 4, 2019], Internet<URL:https//media.dmm-make.com/item/4462/>, cited in the ISR (Ref CD).

LOGQ_FA, [online], Sep. 25, 2018, Osa Co., Gigazine, [Retrieved on Oct. 4, 2019], Internet<URL:https://gigazine.net/news/20180925-self-solving-rubilks-cube/>, non-official translation (A tremendous movie of Self Solving Rubik's Cube which moves itself and aligns the colors on its own is now showing), cited in the ISR (Ref CD).

Touch Lab. "iPhone", [online], May 19, 2014, Excite Japan Co., LRD., excite.news, [Retrieved on Oct. 7, 2019], Internet<URL:https://www.excite.co.jp/news/article/TouchLab_17986/>, non-official translation ("Playable even on iPhone: the logo of Google becomes to Rubik's Cube"), cited in ISR (Ref CD).

International Search Report dated Oct. 15, 2019 in International (PCT) Application No. PCT/JP2019/02950.

*Primary Examiner* — Sunit Pandya
(74) *Attorney, Agent, or Firm* — Wenderoth, Lind & Ponack, L.L.P.

(57) ABSTRACT

The present invention provides a cubic puzzle which is capable of changing its entire body into a cubic block shape ad has an improved entertainment property as a toy.

A controller automatically changes a display pattern to a reference pattern by an actuator, making it a minimum condition that a current pattern being a display pattern at that point of time when identified by a pattern identifying means is different from a reference pattern being a predetermined reference display pattern, while a start state detecting means detects a predetermined start state.

10 Claims, 17 Drawing Sheets

CUBIC PUZZLE

TECHNICAL FIELD

This invention relates to a cubic puzzle capable of changing its entire body into a cubic block shape with a plurality of pieces.

BACKGROUND ARTS

It is well known that there is a cubic puzzle called a Rubik's cube (a registered trademark name, and the same hereinafter) capable of changing its entire body into a cubic block shape with a plurality of pieces.

This cubic puzzle has been popular for a long time as a highly intellectual toy, and a way to play this cubic puzzle has been also well known, whereas its configuration has remained almost unchanged for several decades because it reached a high level of perfection, and besides, how its entertainment property should be improved has become a problem to be solved.

According to a cubic puzzle made up of a Rubik's cube as disclosed in a patent document 1, for instance, although such disclosed cubic puzzle enables a player to have feeling of interest in assembling works, it still has not reached the basic solution of a problem of improving an entertainment property that a toy essentially possesses.

PRIOR ART DOCUMENT

Patent Document

[Patent document 1] Publication of Japanese Utility Model Registration No. 3019273

SUMMARY OF THE INVENTION

Problems to be Solved by the Invention

An object of the present invention is to provide a cubic puzzle which is capable of changing its entire body into a cubic block shape with a plurality of pieces and has an improved entertainment property as a toy.

Means for Solving the Problems

To solve the above problem, the present invention provides a cubic puzzle capable of changing its entire body into a cubic block shape with a plurality of pieces, the cubic puzzle comprising:

a core member arranged at a center side of the cubic puzzle;

the plurality of pieces each having a facet configuring a part of six outside faces formed resulting from change into the block shape, the pieces being arranged side by side so as to cover the whole or approximately whole circumference of the core member, while being in a state where a grid-like pattern displayed on each outside face is obtained with a plurality of facets;

a support mechanism for supporting the plurality of pieces to the core member so that the pieces are rotatable centering around three rotation axes being three virtual linear axes perpendicularly or approximately perpendicularly intersecting one another at the center of the core member; and a controller including an actuator for rotationally driving the pieces and performing control of the actuator;

wherein a rotating unit including the plurality of pieces arranged in a square annular shape circumferentially around each rotation axis is constituted so as to be integrally rotated centering around the each rotation axis;

each of the three rotation axes is provided with a plurality of rotating units which are mutually the same in number and are arranged side by side in an axial direction of the each rotation axis;

a puzzle body including the core member, the pieces and the support mechanism is constituted so as to be subjected to change into the block shape by turning all the rotating units arranged in the axial direction of any one of the rotation axes so as to bring them into a state of being completely or approximately completely overlapped one another in the axial direction of the one rotation axis;

the puzzle body being constituted so as to, at every pattern changing operation by which the puzzle body in a state of being changed into the block shape is subjected to re-change into the block shape by turning any one of the rotating units in the above puzzle body in one direction centering around any one of the rotation axes, allow a combination of the plurality of pieces constituting the other rotating units rotated centering around the rotation axes other than the one rotation axis to be changed;

each facet has a predetermined character, color or pattern, or alternatively, a combination thereof which is displayed in a fixed fashion thereon so as to allow a part of a display pattern composed of display contents on the six outside faces of the puzzle body having been changed into the block shape to be changed at every pattern changing operation;

the controller includes a pattern identifying means for identifying the display pattern and a start state detecting means for detecting a predetermined start state; and the controller is constituted so as to automatically change the display pattern to a reference pattern being a predetermined reference display pattern, making it a minimum condition that a current pattern being a display pattern at the point of time when identified by the pattern identifying means is different from the reference pattern, while the start state detecting means detects the predetermined start state.

It may be possible also that the pattern identifying means includes a rotation sensor for detecting rotation of the rotating units and a storage unit installed in the controller, wherein the controller is constituted so as to, whenever the rotation sensor detects one pattern changing operation, store the display pattern updated by the detected pattern changing operation in the storage unit.

It may be possible also that the controller is constituted so as to derive one or more pattern changing operations required to change from a current pattern being a display pattern at the point of time when stored in the storage unit to the reference pattern according to a unique solution different from a general solution in which each pattern changing operation is to be performed according to a procedure opposite to the procedure of and in a direction opposite to the direction of the plurality of pattern changing operations required to change from the reference pattern to the current pattern.

It may be possible also that the start state detecting means includes an acceleration sensor for detecting action of the puzzle body, wherein the controller is constituted so as to determine that the predetermined start state is detected, making it at least a condition that the acceleration sensor detects that the puzzle body is placed on a predetermined place and keeps a stably stationary condition.

It may be possible also that the start state detecting means includes an attitude detecting means for detecting attitude of the core member, wherein the controller is constituted so as to determine that the predetermined start state is detected, when the attitude detecting means detects that the attitude of the core member is changed to a predetermined attitude.

It may be possible also that the cubic puzzle further includes a rotation sensor for detecting rotation of the rotating units, wherein the controller is constituted so as to change a rotating unit position to a target position being a predetermined turning position by driving the rotating unit for turning by a predetermined amount in a second direction being a direction opposite to a first direction being one direction, followed by driving the thus turned rotating unit for turning in the first direction, or alternatively, by driving the rotating unit for turning in the second direction being a turning direction opposite to the first direction, when the rotation sensor detects a state in which the turning motion of the rotating unit is stopped or regulated, in the middle of an operation by which the rotating unit position is changed to the target position by driving the rotating unit for turning in the first direction.

It may be possible also that the cubic puzzle further includes a rotation sensor for detecting rotation of the rotating units, wherein the controller is constituted so as to perform a preliminary turning operation by which the rotating unit which is other than the rotating unit to be turned and possibly causes a failure state for bringing about stop or regulation of the turning motion of the rotating unit to be turned is turned by a predetermined amount in a direction opposite to a direction in which the failure state may occur, when performing turning of the rotating unit to be turned.

It may be possible also that the cubic puzzle further includes a clutch mechanism for disconnecting power transmission so as to prevent manual operation force from the rotating units from being transmitted to the actuator, while permitting power transmission from the actuator to the rotating units.

It may be possible also that the controller includes a control unit installed inside of the puzzle body and a radio-communicable information terminal arranged outside of the puzzle body separately from both the puzzle body and the control unit, and is provided with a radio communication means enabling radio communication between the control unit and the information terminal.

It may be possible also that the pattern identifying means includes the radio communication means and the information terminal, wherein the controller is constituted so as to identify the current pattern based on image data of a photographed image of the puzzle body which is in the state of being changed into the block shape.

Effects of the Invention

In the cubic puzzle capable of changing its entire body into the cubic block shape with the plurality of pieces, its entertainment property as the toy is improved because of implementation of an automatic change to the reference pattern by the actuator owing to the conditions under which the change of the display pattern from the reference pattern is performed and the start state is met, while playing with this cubic puzzle in the same way as before is realizable by a manual pattern changing operation.

MODE FOR EMBODYING THE INVENTION

Figure 1:
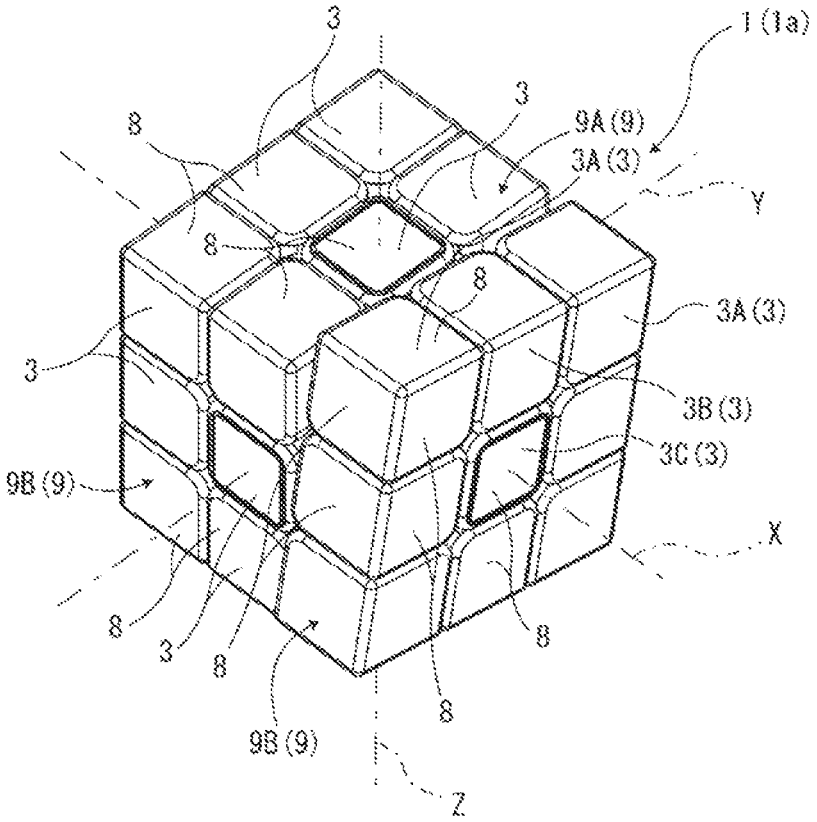
FIG. 1 is a perspective view showing a cubic puzzle obtained by application of the present invention.
Figure 2:
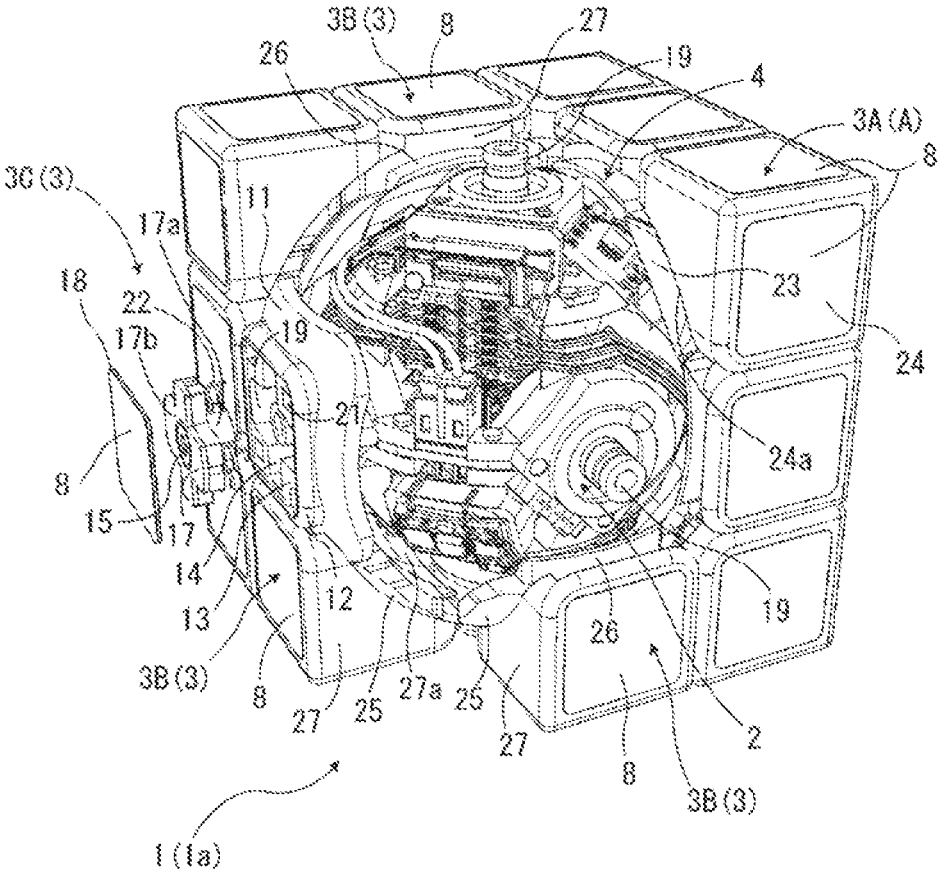
FIG. 2 is a perspective view showing a state in which the cubic puzzle shown in FIG. 1 is partially exploded.

FIG. 1 is a perspective view showing a cubic puzzle obtained by application of the present invention, and FIG. 2 is a perspective view showing a state in which the cubic puzzle shown in FIG. 1 is partially exploded. An illustrated cubic puzzle 1 belongs to a Rubik's cube capable of being changed into the shape of a cubic block. In the Rubik's cube of this type, there is a Rubik's cube called "n×n×n Rubik's cube" constituted such that each of six square outside faces forming the block shape has a grid-like pattern in n columns and n lines, wherein "n" represents an integer of not less than 2. Referring to the illustrated embodiment, a value of "n" is set to 3.

The cubic puzzle 1 has a core member 2 arranged at a center side of the cubic puzzle and formed in a spherical shape, a plurality of pieces 3 arranged side by side so as to cover the whole or approximately whole front, back, right, left, upside and downside circumferences of the core member 2, a support mechanism 4 for supporting the plurality of pieces 3 to the core member 2 in a rotatable manner, and a controller including an electric motor 6 (see FIGS. 5 and 6) being an actuator for rotationally driving the pieces 3. The core member 2, the pieces 3 and the support mechanism 4 constitute a puzzle body 1*a*.

Each piece 3 has one or more square facets 8 configuring a part of the six outside faces of the puzzle body 1*a* (the cubic puzzle 1) which is in a state of being changed into the block shape. More specifically, each of the above outside faces is constituted of n×n (3×3=9, in this embodiment) facets 8 in total. In other words, a grid-like pattern displayed on each outside face is obtained with the plurality of facets 8 arranged in grid-like array in n columns and n lines.

The support mechanism 4 is constituted so as to support the corresponding pieces 3 to the core member 2 so that the pieces are rotatable centering around three rotation axes X, Y, Z being three virtual linear axes perpendicularly or approximately perpendicularly intersecting one another at the center of the core member 2. Each of the rotation axes X, Y, Z is vertical to a pair of corresponding parallel outside faces of the puzzle body 1*a* which is in the state of being changed into the block shape.

A plurality of rotating units 9 (three rotating units, in the illustrated embodiment) each including the plurality of pieces 3 (eight pieces, in the illustrated embodiment) arranged in a square annular shape circumferentially around any arbitrarily selected one (the rotation axis X, for instance) of the three rotation axes X, Y, Z are in side-by-side arrangement in the axial direction of the rotation axis X. The same grouping as the above is also applied to each of the two rotation axes Y, Z other than the rotation axis X. Then, the rotating units 9 (nine rotating units, in this embodiment) as many as a value obtained by multiplying three or the number of the rotation axes X, Y, Z by the above value of "n" are provided to constitute one puzzle body 1*a*.

It is noted that the pieces 3 each positioned at a vertex portion where three outside faces are gathered resulting from changing the puzzle body 1*a* into the block shape form corner pieces 3A each having three facets 8 configuring each part of the three outside faces. By the way, for the cubic puzzle 1 made up of a type of 2×2×2 Rubik's cube, all the pieces 3 having the facets 8 configuring the outside faces form the corner pieces 3A.

For the cubic puzzle 1 made up of a type of 3×3×3 Rubik's cube, the pieces 3 include not only the corner pieces 3A but also edge pieces 3B each positioned at a cross-sectionally L-shaped corner portion defined by the two outside faces formed resulting from changing the puzzle body 1*a* into the block shape and having two facets 8 configuring each part of the above two outside faces and center pieces 3C each positioned at the center of each of the six outside faces formed resulting from changing the puzzle body 1*a* into the block shape and having only one facet 8 configuring each part of the above six outside faces.

The center pieces 3C are provided as many as the number of outside faces, that is, the six outside faces, wherein each center piece is positioned on any one of the rotation axes X, Y, Z and is supported to the core member 2 rotatably centering around the one rotation axis X, Y, Z.

For the cubic puzzle 1 made up of a type of 4×4×4 Rubik's cube, a plurality of middle pieces are further included as the pieces 3 positioned on each of the six outside faces formed resulting from changing the puzzle body 1*a* into the block shape and having only one facet 8 configuring each part of the above six outside faces. There are provided four middle pieces 3 in total which are arranged in array in two columns and two lines at positions surrounded by the four corner and eight edge pieces 3A and 3B arranged in the square annular shape at each outside face side, wherein a grid-like pattern displayed on each outside face is obtained with the facets of the middle pieces together with those of the above corner and edge pieces 3A and 3B.

Even the cubic puzzle 1 of this type has the center piece 3C at every one of the six outside faces, wherein this center piece 3C is arranged on any one of the rotation axes X, Y, Z in between the middle piece and the core member 2 without having any facet 8. This center piece 3C is supported to the core member 2 rotatably centering around the one rotation axis X, Y, Z. By the way, even for the cubic puzzle made up of the type of 2×2×2 Rubik's cube, the center piece 3C having no facet 8 is provided inside of the cubic puzzle 1.

In generalizing the above, when the value of "n" is set to an odd number of not less than 3, the center piece 3C having one facet 8 is arranged such that the facet 8 thereof is positioned on each outside face, wherein the each outside face is constituted of the facets 8 of four corner pieces 3A, 4×(n−2) edge pieces 3B, one center piece 3C and ((n−2)×(n−2)−1) middle pieces.

Meanwhile, when the value of "n" is set to an even number of not less than two, the center piece 3C having no facet 8 is arranged inside of the puzzle body 1*a*, wherein each outside face is constituted of the facets 8 of four corner pieces 3A, 4×(n−2) edge pieces 3B and (n−2)×(n−2) middle pieces.

Hereinafter will be described a cubic puzzle constitution by taking the type of 3×3×3 Rubik's cube for instance.

The puzzle body 1*a* (the cubic puzzle 1) is subjected to change into the block shape by the manner in which the turning positions of all the rotating units 9 arranged on any arbitrarily selected one (the rotation axis X, for instance) of the three rotation axes X, Y, Z are made to coincide or approximately coincide as viewed in the axial direction of the rotation axis X.

When performing a pattern changing operation by which the puzzle body 1*a* in a state of being changed into the block shape is subjected to re-change into the block shape by turning any selected one of all the rotating units 9 by quarter or approximately quarter turns relative to the other rotating units 9 arranged on the same rotation axis X, Y, Z as the rotation axis of the one rotating unit 9, a combination of the facets 8 configuring each of the outside faces arranged in the annular shape circumferentially around the above same rotation axis X, Y, Z is changed. In other words, a combination of the plurality of pieces 3 constituting each of the other rotating units 9 arranged on the rotation axes Y, Z other than the one rotation axis (the rotation axis X, for instance) of the rotating unit 9 as a target of the pattern changing operation is changed at every pattern changing operation.

Each facet 8 has a predetermined character, color or pattern, or alternatively, a combination thereof which is displayed in a fixed fashion thereon by direct printing, sticking of a sheet such as a seal printed with the above or like means so as to be allowed to differ in display contents on the four outside faces arranged in the annular shape circumferentially around the rotation axis X, Y, Z of the rotating unit 9 as the target of the pattern changing operation, at every pattern changing operation.

Then, a display pattern including all the display contents on each of the six outside faces of the puzzle body 1*a* (the cubic puzzle 1) having been changed into the block shape is changed at every pattern changing operation. In this process, a predetermined display pattern is specified as a reference pattern.

For instance, the display pattern specified as the reference pattern may also include a display pattern in which all the plurality of facets 8 positioned on the same outside face have the same or approximately same color, while colors of the six outside faces are mutually different. In this case, six mutually different colors are prepared, and the nine facets 8 are provided for every one of the six mutually different colors.

Further, a display pattern in which the six outside faces have mutually different patterns may be also included.

Then, the cubic puzzle 1 with the display pattern changed to the reference pattern is subjected to a plurality of times of pattern changing operations to change from the reference pattern to an arbitrary display pattern. The cubic puzzle 1 having been changed into the block shape with the arbitrary display pattern other than the reference pattern displayed thereon in this manner results in making only the display contents on one of the outside faces identical with the display contents on one outside face forming the reference pattern (for instance, one outside face is only constituted of the facets of the same color), and also in making the display contents on all the six outside faces identical with the reference pattern, so that it can be believed that this cubic puzzle is enjoyed in a way of performing a plurality of appropriate pattern changing operations and so on.

Figure 3:
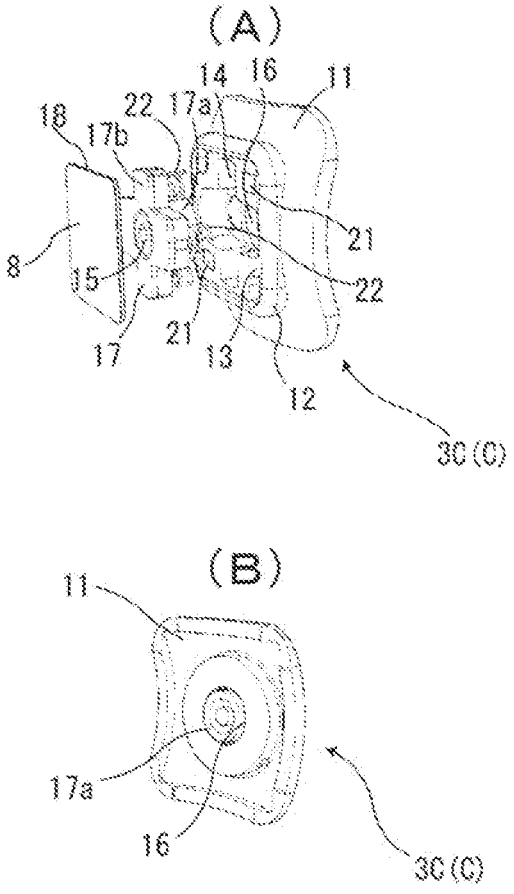
FIGS. 3(A) and 3(B) are respectively an exploded perspective view showing an outside face side of a center piece and a perspective view showing an inside face side thereof.

Next will be described the constitution of each piece 3 with reference to FIGS. 2 and 3.

FIGS. 3(A) and 3(B) are respectively an exploded perspective view showing an outside face side of the center piece and a perspective view showing an inside face side thereof. The center piece 3C has an engagement part 11 being a plate-like portion formed in a curved surface shape so as to conform to an outside face of the spherical core member 2 and arranged such that a center side of the engagement part is positioned on any one of the rotation axes X, Y, Z, and a body part 12 formed in a square shape as viewed in the axial direction of the one rotation axis X, Y, Z and integrally protruding stepwise outwards (in a direction away from the core member 2) in the axial direction of the one rotation axis X, Y, Z from a portion close to the center of the engagement part 11.

The body part 12 has, in a range of its most part close to the center in an outside face of the body part 12, a recess part 13 having a square shape as viewed in the axial direction of any one of the rotation axes X, Y, Z passing the center of the body part 12, the recess part 13 being concaved inwardly in the axial direction of the one rotation axis X, Y, Z. The center piece 3C has, on a flat bottom face of the recess part 13, a receiving groove 14 concaved more deeply than the recess part 13 by a step.

The receiving groove 14 in the center piece 3C is formed in a shape (a cross shape in the illustrated embodiment) other than a circular shape such that crosses are formed on any one of the rotation axes X, Y, Z passing the center of the center piece 3C and the center of the cross is positioned on the one rotation axis X, Y, Z as viewed in the axial direction of the one rotation axis X, Y, Z. The receiving groove 14 has, on its center part, an insertion hole 16 penetrating the center piece 3C in the axial direction of any one of the rotation axes X, Y, Z passing the center of the center piece 3C in which the receiving groove 14 is formed.

The center piece 3C further has a fixing member 17 and a square panel 18 fittingly fixed to the recess part 13.

The fixing member 17 has, as an integral unit, a cylindrical shaft part 17*a* having a shaft center on any one of the rotation axes X, Y, Z so as to be fittingly insertable into the insertion hole 16 and a fitting part 17*b* having the same shape (a cross shape in the illustrated embodiment) as the shape of the receiving groove 14 in the axial direction of the one rotation axis X, Y, Z so as to be fittingly receivable in the receiving groove 14. The fixing member 17 is constituted so as to fittingly receive the whole of the fitting part 17*b* in the receiving groove 14 such that the shaft part 17*a* is inserted through the insertion hole 16. In this state, a distal end of the shaft part 17*a* of the fixing member 17 faces to an inside face side being a core member 2-side face of the engagement part 11.

When detachably attaching and fixing the distal end of the shaft part 17*a* to a drive shaft 19 having a shaft center coaxial with that of the shaft part 17*a* and rotationally driven by the motor 6, the center piece 3C is supported to the core member 2-side rotatably centering around any one of the rotation axes X, Y, Z. In other words, the center piece 3C is rotated integrally with the drive shaft 19 wherein each rotation axis X, Y, Z is made the shaft center. By the way, when fittingly fixing the drive shaft 19 to an inner peripheral face side of the cylindrical shaft part 17*a* with a screw 15, the center piece 3C is detachably attached and fixed to the drive shaft 19.

The panel 18 is fittingly fixed to the recess part 13 in a detachable manner in a state where the fitting part 17*b* of the fixing member 17 is received in the receiving groove 14 while the shaft part 17*a* of the fixing member 17 is inserted through the insertion hole 16. An outside face of the panel 18 forms the facet 8. Fixation of the panel 18 to the inside of the recess part 13 may be also by attracting the inside face of the panel 18 to a bottom face side of the recess part 13 with a magnet 21 installed on a bottom face of the recess part 13, or alternatively, by fittingly fixing the panel 18 to the recess part 13 in the detachable manner. For fixation of the panel by means of attraction with the magnet 21, the panel 18 is formed of metal or like material which is made attractable by the magnet 21. Otherwise, the panel 18 is formed of a synthetic resin material.

Further, an elastic member such as a compression spring 22 arranged between the fitting part 17*b* and the bottom face of the receiving groove 14 elastically energizes the engagement part 11 of the center piece 3C and the other pieces 3 engaged with the engagement part 11 toward the core member 2-side, thereby allowing integration of the center piece 3C with the other pieces 3 constituting one rotating unit 9 together with the above center piece 3C to be promoted.

It is noted that a connector for connection to an external power supply may be also installed in the recess part 13. In this case, the cubic puzzle 1 is charged by making connection between the connector in an exposed state resulting from removal of the panel 18 from the recess part 13 and a power supply terminal for power supply from the external power supply. Alternatively, the connector may be also exposed from the panel 18 so as to enable use of the connector with the panel 18 fittingly fixed to the recess part 14.

The corner piece 3A has an engagement part 23 being a plate-like portion formed in a curved surface shape so as to conform to the outside face of the spherical core member 2 and a body part 24. The body part 24 is formed partly in such cutout shape as obtained by cutting out one vertex portion of a cube. A resultant cutout portion of the body part 24 configures a recess part 24*a* formed in a concavely curved surface shape so as to conform to the engagement part 23. The engagement part 23 is arranged at a recess part 24*a*-side of the body part 24 and connected to the body part 24. Meanwhile, each of the three faces respectively uncontacted with the recess part 24*a* in the body part 24 formed in a cubic shape forms the facet 8.

The corner piece 3A is supported to the core member 2-side rotatably in the direction around any one of the rotation axes X, Y, Z by engagement with the plurality of adjacent edge pieces 3B.

The edge piece 3B has engagement parts 25, 26 each formed in a circular arc shape so as to conform to the outside face of the spherical core member 2 and a body part 27. The body part 27 is formed partly in such cutout shape as obtained by cutting out the whole of a corner portion where the two outside faces among the six outside faces cross each other. The engagement part 26 is integrally extended toward the center piece 3C-side from each of the opposite end sides close to the center piece 3C in a recess part 27*a* being a resultant cutout portion of the body part 27, while the engagement part 25 is integrally extended toward an edge piece 3B-side from each of the opposite end sides close to the edge piece 3B in the recess part 27*a*. Meanwhile, each of the two faces adjacent to the center piece 3C in the body part 27 forms the facet 8, with the puzzle body 1*a* changed into the block shape.

The edge piece 3B is supported rotatably in the direction around any one of the rotation axes X, Y, Z by engagement of a pair of engagement parts 26, 26 extending toward the center piece 3C-side in a position between the engagement part 11 of the center piece 3C and the outside face of the core member 2. Meanwhile, the corner piece 3A is supported rotatably in the direction around any one of the rotation axes X, Y, Z by engagement of the engagement part 23 thereof in a position between the engagement part 25 extending toward the corner piece 3A-side in each of the three edge pieces 3B adjacent to the corner piece 3A and the outside face of the core member 2. By the way, in the illustrated embodiment, the engagement part 23 of the corner piece 3A does not reach the engagement part 11 of the center piece 3C yet when the puzzle body 1*a* is being changed into the block shape, whereas it gets positioned between the engagement part 11 of the center piece 3C and the outside face of the core member 2 at the time of the pattern changing operation. In this case, however, it is also allowable to enlarge an extent of the engagement part 23 of the corner piece 3A so as to allow the engagement part 23 to be positioned between the engagement part 11 of the center piece 3C and the outside face of the core member 2, with the puzzle body 1A changed into the block shape.

The faces other than the face forming the facet 8 among the faces of the body parts 12, 24 and 27 in the pair of mutually adjacent pieces 3, 3 constituting the part of the rotating unit 9 mutually make transmission of force in close proximity to or contact with each other in a linear manner as viewed in the axial direction of any one of the rotation axes X, Y, Z being the rotation fulcrum of the rotating unit 9. For that reason, when applying rotational driving force being force of rotation in the direction around any one of the rotation axes X, Y, Z to at least one of the plurality of pieces 3 constituting the rotating unit 9, all the pieces 3 constituting the rotating unit 9 are integrally rotated. The mutually adjacent ones of the engagement parts 23, 25, 26 of the plurality of pieces 3, 3 arranged in a cubic annular shape around any one of the rotation axes X, Y, Z of the individual rotating unit 9 are connected together into the form of an annular configuration on the whole as viewed in the axial direction of the one rotation axis X, Y, Z, thereby enabling smooth rotation of the rotating unit 9 to be obtained.

By the way, a position of rotation of one of the plurality of rotating units 9 arranged in the axial direction of any one of the rotation axes X, Y, Z is relatively changed by rotational driving of the remaining rotating units 9 by the motor 6. Thus, one of the plurality of rotating units 9 arranged in the axial direction of the one rotation axis X, Y, Z forms a non-drive side rotating unit 9A having no need of being rotationally driven by the motor 6, while each of the remaining rotating units 9 forms a drive side rotating unit 9B rotationally driven by the motor 6.

For the illustrated cubic puzzle 1 made up of the type of 3×3×3 Rubik's cube, each of the six rotating units 9 positioned at the outside face side at the time when the puzzle body is changed into the block shape is specified as the drive side rotating unit 9B, while each of the three rotating units 9 sandwiched between the two drive side rotating units 9B, 9B in the axial direction of the one rotation axis X, Y, Z is specified as the non-drive side rotating unit 9A.

Then, the rotational driving force from the motor 6 is transmitted to one piece 3 (the center piece 3C in the illustrated embodiment) constituting each drive side rotating unit 9B to rotationally drive the each drive side rotating unit 9B. It is noted that the motor 6 may be also provided for each drive side rotating unit 9B, or alternatively, it is also allowable to provide a clutch mechanism so that the number of motors 6 is reduced.

For instance, provided that there is one motor 6, a clutch mechanism for intermittently transmitting the rotational driving force from the motor 6 to the drive side rotating units 9B may be also provided for each of the drive side rotating units 9B. In this case, if the clutch mechanism is constituted so as to be capable of controlling intermittent transmission in response to an electric signal, use of one motor 6 and the six clutch mechanisms enables the six drive side rotating units 9B to be rotationally driven. Alternatively, provided that there is the motor 6 for each of the rotation axes X, Y, Z, a clutch mechanism for intermittently transmitting the rotational driving force from the motor 6 to the drive side rotating units 9B may be also provided for each drive side rotating unit 9B on each of the rotation axes X, Y, Z. In this case, if each of the three clutch mechanisms is constituted so as to be capable of controlling intermittent transmission in response to an electric signal, use of the three motors 6 and the three clutch mechanisms enables the six drive side rotating units 9B to be rotationally driven.

It is noted that the middle piece 3 has an engagement part formed in a curved surface shape so as to conform to the outside face of the spherical core member 2, and a body part being a protrusion part formed so as to protrude outwards from the engagement part, wherein a flat outside face of the body part forms the facet 8.

Further, the center piece 3C having no facet 8 has an engagement part for causing the four corner pieces 3A or four middle pieces adjacently arranged around any one of the rotation axes X, Y, Z to integrally rotate in the direction around the one rotation axis X, Y, Z, while permitting the four corner pieces 3A or four middle pieces to rotate around the rotation axes X, Y, Z other than the one rotation axis. The rotational driving force from the motor 6 is transmitted to the center piece 3C having no facet 8.

Next will be described the core member 2, the support mechanism 4 and a controller with reference to FIGS. 2, 4, 5 and 6.

Figure 4:
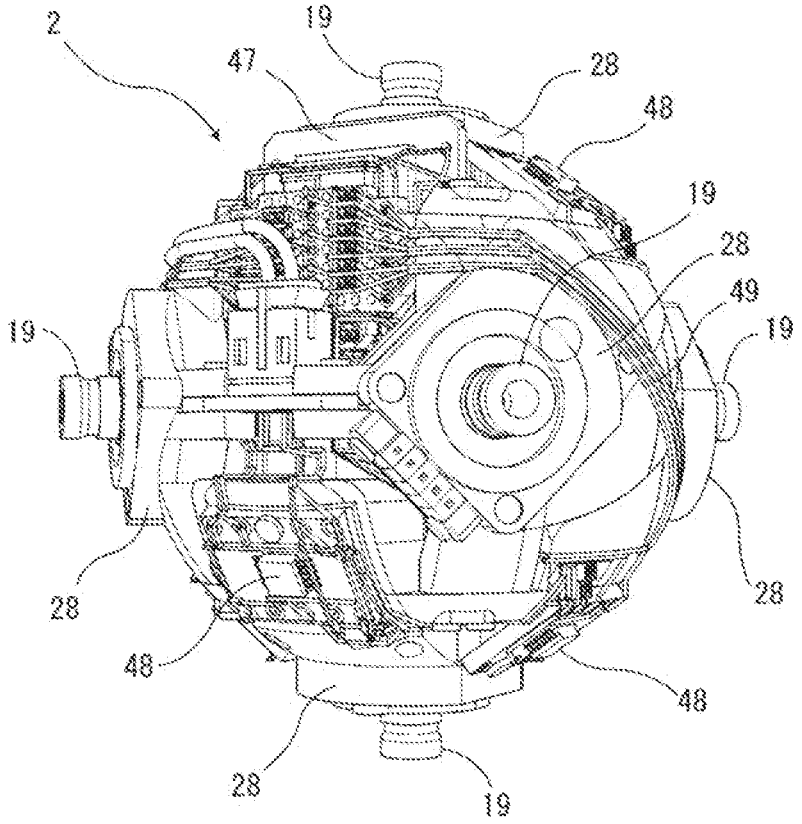
FIG. 4 is a perspective view showing a core member and various parts included therein.
Figure 5:
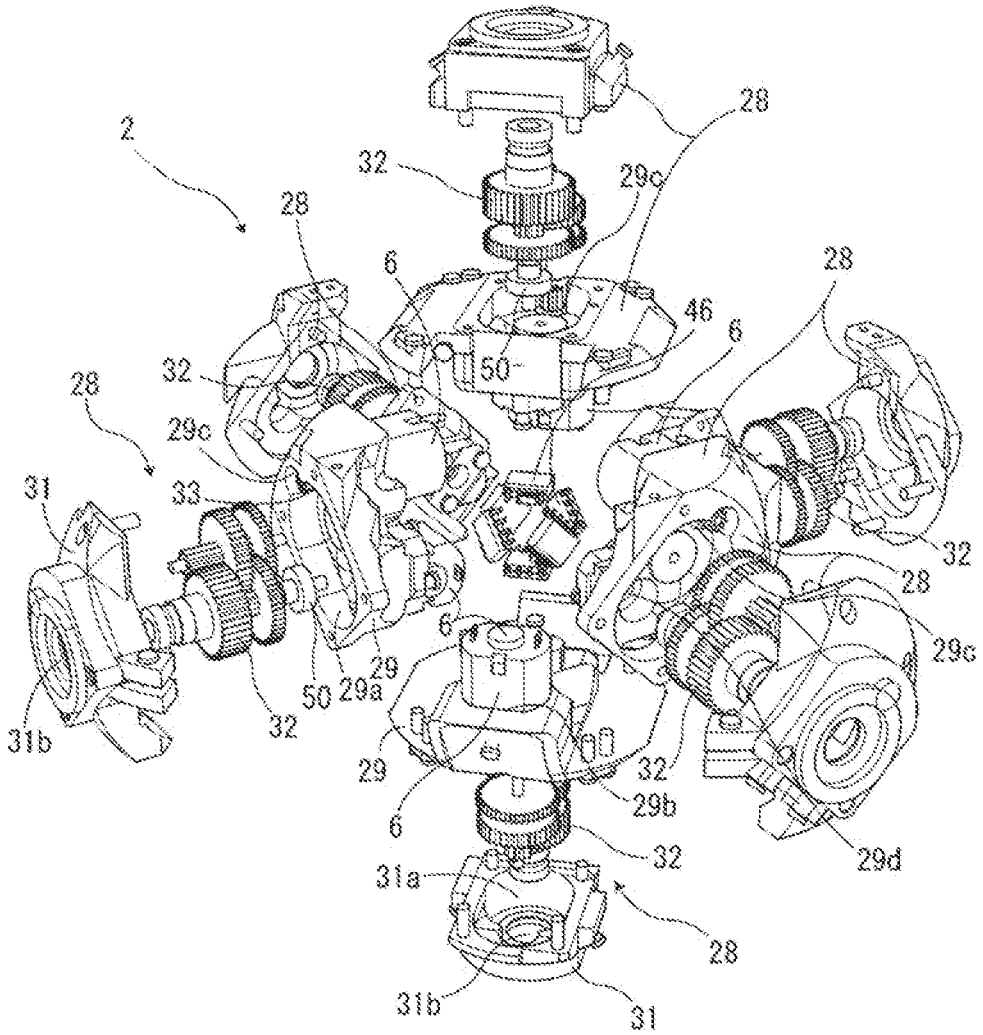
FIG. 5 is an exploded perspective view showing the core member and the various parts included therein.
Figure 6:
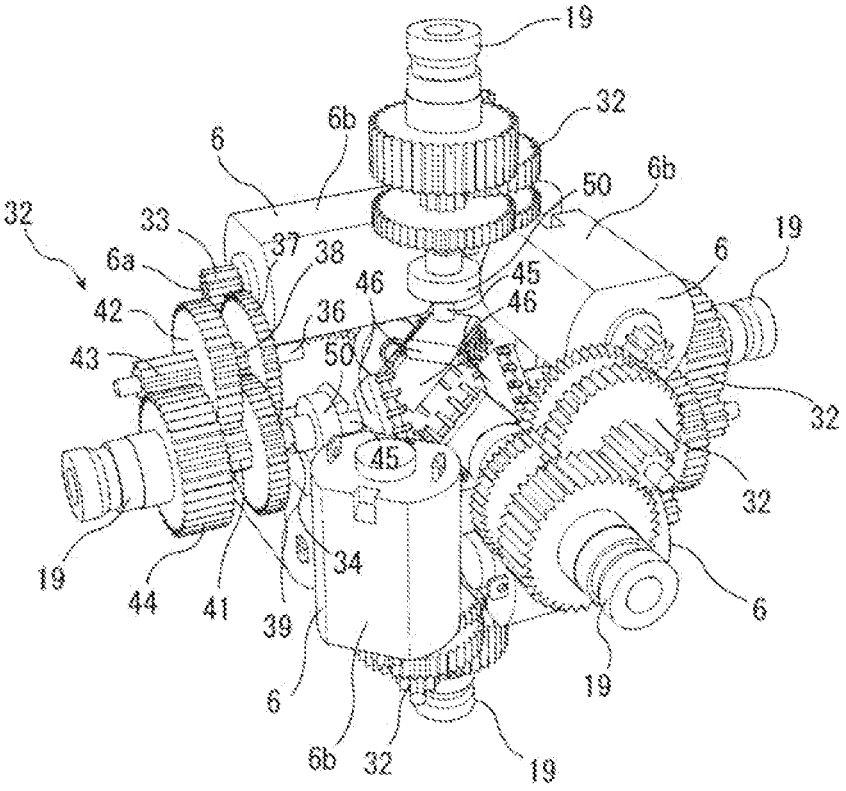
FIG. 6 is a perspective view showing the arrangement configuration of a motor, a transmission mechanism and a rotation sensor.

FIGS. 4 and 5 are a perspective view and an exploded perspective view respectively showing a core member and various parts included therein, and FIG. 6 is a perspective view showing the arrangement configuration of a motor, a transmission mechanism and a rotation sensor. The core member 2 has a unitizing part 28 individually provided for each of the six motors.

There are provided two unitizing parts 28 for each of the rotation axes X, Y, Z. Each unitizing part 28 has an inside part piece member 29 arranged at an inside being a side close to the center of the core member 2 and an outside part piece member 31 arranged at an outside being a side away from the center thereof.

The inside part piece member 29 has a first recess part 29*a* on a face (an outside face) at an outside being a side away from the center of the core member 2 and a second recess part 29*b* on a face (an inside face) at an inside being a side close to the center thereof. Meanwhile, the outside part piece member 31 has a recess part 31*a* on an inside face being a face at the inside of the outside part piece member 31, the recess part 31*a* being opened toward the center of the core member 2. The first recess part 29*a* and the recess part 31*a* are formed in the same or approximately same oblong hole shape in cross sectional view in the axial direction of any one of the rotation axes X, Y, Z passing the unitizing part 28 in which these recess parts are formed.

The first recess part 29*a* of the inside part piece member 29 is opened toward the outside and arranged on any one of the rotation axes X, Y, Z passing the inside part piece member 29. When detachably attaching and fixing the outside part piece member 31 to the outside face of the inside pat piece member 29 with screws or the like so as to cover the first recess part 29*a*, the first recess part 29*a* and the recess part 31 are integrally connected together so that a single installation space is formed. A transmission mechanism 32 for transmitting the rotational driving force from the motor 6 to the drive shaft 19 is housed in the installation space.

The drive shaft 19 constituting the part of the transmission mechanism 32 gets protruding outwards from the core member 2 after passing through an insertion hole 31*b* formed ranging from a bottom face of the recess part 31*a* of the outside part piece member 31 to an outside face the outside part piece member 31.

The second recess part 29*b* of the inside part piece member 29 is arranged at a position offset by a predetermined distance from any one of the rotation axes X, Y, Z passing the inside part piece member 29, and communicates with the first recess part 29*a* through a communication hole 29*a* formed in parallel to the one rotation axis X, Y, Z. The second recess part 29*b* is opened toward the inside, and to which a part of the motor 6 is fixed after being detachably inserted therein in a fitted state.

When the motor 6 is fixed to the second recess part 29*b*, an output shaft 6*a* of the motor 6 gets protruding toward the inside of the first recess part 29*a* after passing through the communication hole 29*c*, so that an output gear 33 is attached and fixed to a portion protruding toward the inside of the first recess part 29*a* in the output shaft 6*a*. By the way, the output shaft 6*a* of the motor 6 is held in a posture parallel or approximately parallel to any one of the rotation axes X, Y, Z passing the unitizing part 28 to which the motor 6 is fixed.

The transmission mechanism 32 has not only the above drive shaft 19 but also a support shaft 34 arranged on any one of the rotation axes X, Y, Z passing the unitizing part 28 provided with the transmission mechanism 32, a support shaft 36 arranged between the support shaft 34 and the output shaft 6*a*, and a plurality of gears 37, 38, 39, 41, 42, 43, 44 respectively supported on the support shafts 34, 36.

The two support shafts 34, 36 are supported in parallel to the output shaft 6*a* so as to be laid between the bottom face of the first recess part 29*a* and that of the recess part 31*a*. The large-diameter gear 37 rotatably supported on the support shaft 36 and constantly geared with the output gear 33 is rotated integrally with the small-diameter gear 38 rotatably mounted on the support shaft 36. The large-diameter gear 39 rotatably supported on the support shaft 34 and constantly geared with the small-diameter gear 38 is rotated integrally with the small-diameter gear 41 rotatably mounted on the support shaft 34.

The large-diameter gear 42 rotatably supported on the support shaft 36 and constantly geared with the small-diameter gear 41 is rotated integrally with the small-diameter gear 43 rotatably mounted on the support shaft 36. The support shaft 34 is provided with the large-diameter gear 44 constantly geared with the small-diameter gear 43 and rotated integrally with the support shaft 34, in addition to the drive shaft 19 rotated integrally with the support shaft 34, thereby allowing the rotational driving force from the motor 6 to be transmitted to the drive shaft 19.

The mutually adjacent ones of the six unitizing parts 28 each unitizing the motor 6 and the transmission mechanism 32 respectively provided for each drive side rotating unit 9B are detachably fixed together with fixtures such as screws and bolts to form the core member 2 on the whole, With the above structure, the support mechanism 4 for supporting each piece 3 to the core member 2-side rotatably centering around any one of the rotation axes X, Y, Z is constituted of the drive shaft 19 and the engagement parts 11, 23, 25, 26 and the body parts 12, 24, 27 of each piece 3.

By the way, the motors 6, 6 respectively installed at the pair of unitizing parts 28, 28 positioned on any one of the rotation axes X, Y, Z are arranged at positions offset by a predetermined distance in the mutually opposite directions from the one rotation axis X, Y, Z.

For more details, the motors 6, 6 respectively at the pair of unitizing parts 28, 28 on any one of the rotation axes X, Y, Z are arranged at symmetrical positions with respect to the one rotation axis X, Y, Z as viewed in the axial direction of the one rotation axis X, Y, Z. Such arrangement of the motors makes it possible to prevent mutual interference of the motors 6, 6 respectively at the pair of unitizing parts 28, 28 on any one of the rotation axes X, Y, Z from occurring when the motors are brought close to each other in the axial direction of the one rotation axis X, Y, Z.

Further, each motor 6 has flat cutout faces 6*b* formed at symmetrical positions with respect to the shaft center in a cross-sectionally circular-shaped outer peripheral face of the each motor. The motors 6, 6 respectively at the two unitizing parts 28, 28 on any one of the rotation axes X, Y, Z are fixed in a posture in which the cutout faces 6*b* thereof are inclined by about 45 degrees to the outside faces at the side close thereto in the puzzle body 1*a* which is in the state of being changed into the block shape. Meanwhile, the motor 6 other than the above motors is fixed in a posture in which the cutout face 6*b* thereof is in parallel or approximately parallel to the outside face at a side close thereto in the puzzle body 1*b* which is in the state of being changed into the block shape, thereby preventing the transmission mechanism 32 including the large-diameter gear 37 arranged close to the above other motor from interfering with the cutout face 6*b* of the other motor.

Moreover, rotation (more specifically, such as the direction, position, amount and speed of rotation) of the support shaft 34 is capable of being detected by a rotation sensor (a rotation detecting means) 46 arranged at the side close to the center of the core member 2. In the illustrated embodiment, the rotation sensor 46 is provided individually for each of the transmission mechanisms 32 to detect a cylindrical magnet 45 mounted on one end at a side away from the center of the core member 2 in the support shaft 34 and rotated integrally with the support shaft 34. It is noted that the support shaft 34 has a bearing 50 at a position adjacent to the magnet 45, so that the bearing 50 allows the support shaft 34 to be supported to the core member 2 in an idling state. By the way, one end mounted with the magnet 45 in the support shaft 34 protrudes toward the center of the core member 2 from the inside part piece member 29 after passing through an insertion hole 29*d* formed ranging from the bottom face of the first recess part 29*a* of the inside part piece member 29 to the inside face thereof. Further, in this embodiment, the transmission mechanism 32 is provided for each drive side rotating unit 9B, so that there is provided the rotation sensor 46 individually for every one of the drive side rotating units 9B.

For the cubic puzzle 1 made up of the type of 3×3×3 Rubik's cube, it is noted that although the rotation sensor 46 performs detection of the operation of the drive side rotating units 9B, it is possible of course to play this cubic puzzle by rotating or turning the non-drive side rotating unit 9A, wherein the operation of the non-drive side rotating unit 9A is detected by the rotation sensors 46, 46 for detection of the operation of the drive side rotating units 9B, 9B respectively arranged at the opposite sides of the non-drive side rotating unit 9A.

Besides, a part of a control substrate 47 mounted with a microcomputer and one or more internal power supplies (not shown) such as cells and rechargeable batteries are housed in the core member 2 in a fixed fashion. Further, the core member 2 has, on its outside face, a motor driver 48 being an IC chip for controlling the presence/absence of rotational driving of the motor 6 and the direction of rotation thereof in response to an electric signal outputted from the microcomputer, in addition to various wirings 49 for appropriately electric connection of the rotation sensor 46, the microcomputer, the control substrate 47 and/or the motor driver 48. It is noted that the motor driver 48 and/or the wirings 49 may be arranged of course at the inside of the core member 2 and/or other places.

In this embodiment, the microcomputer, the power supply, the motor driver 48 and the wirings 49 or the like constitute a control unit 51 (see FIG. 7) for executing control such as drive control of the motor 6. Meanwhile, the controller described the above is constituted of the control unit 51, the motor driver 48 and various detecting means including the rotation sensor 46.

Thus, the core member 2 allows the controller to be also unitized there-into together with the motor 6 and the transmission mechanism 32.

Next will be described the contents of control executed by the controller with reference to FIGS. 7 and 8.

Figure 7:
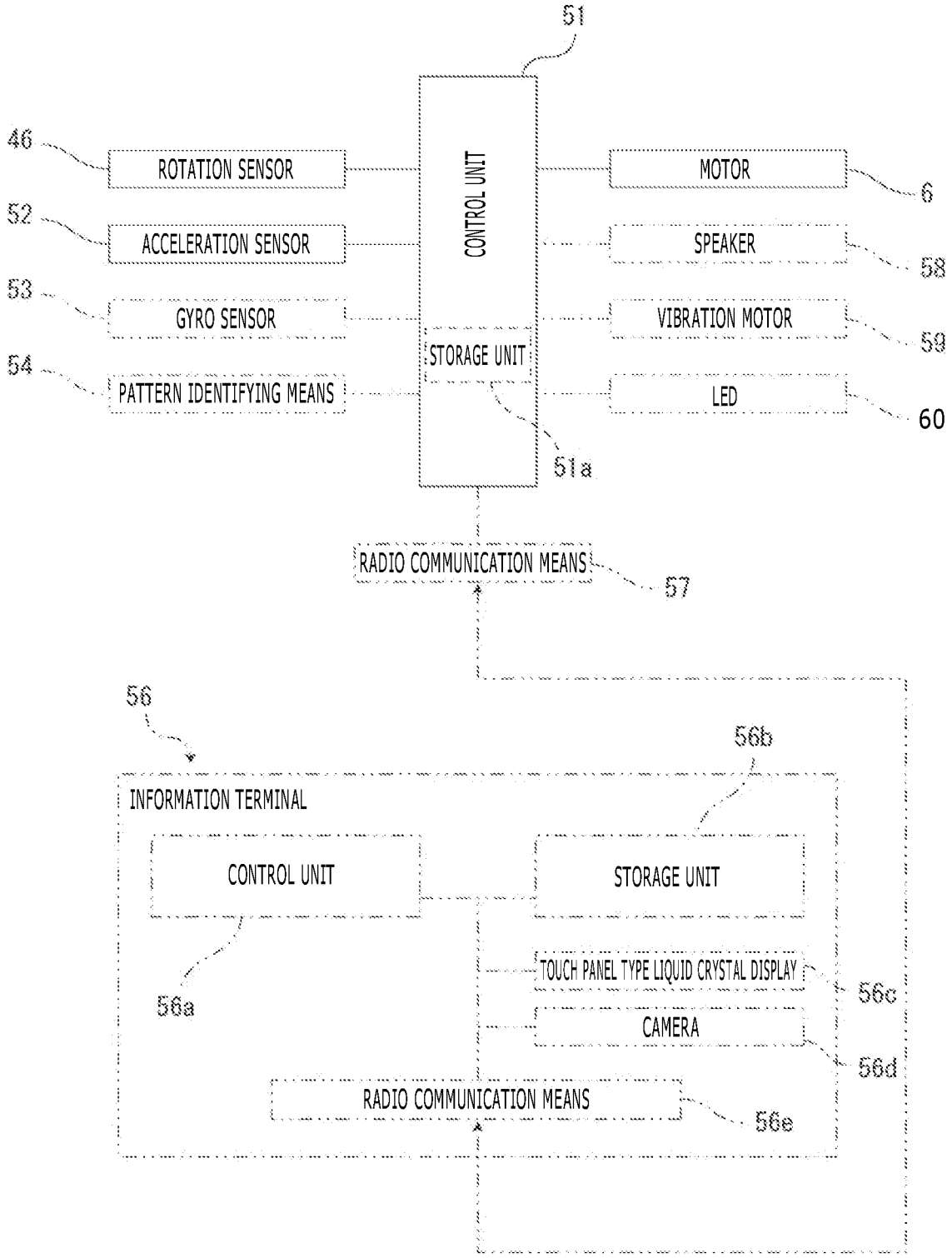
FIG. 7 is a block diagram showing the constitution of a controller.

FIG. 7 is a block diagram showing the constitution of a controller. To an input side of the control unit 51 are connected the six rotation sensors 46 and an acceleration sensor (an acceleration detecting means) 52. To an output side of the control unit 51 are connected the six motors 6. The acceleration senor 52 is a tri-axial acceleration sensor installed at the core member 2-side and enables detection of three-dimensional operation of the puzzle body 1*a* to be performed in real time. The motor 6 is connected through the motor driver 48 constituting the part of the control unit 51 to an electric signal output port in the microcomputer constituting the part of the control unit 51 likewise.

The control unit 51 has a storage unit 51*a* and stores various information in the storage unit 51*a*. The storage unit 51*a* is constituted of a non-volatile memory or the like unitized into the microcomputer and capable of holding stored information even when the power supply is off. A RAM provides the microcomputer with an execution environment of a program for implementation of various processing and also may constitute a part of the storage unit 51*a*.

Figure 8:
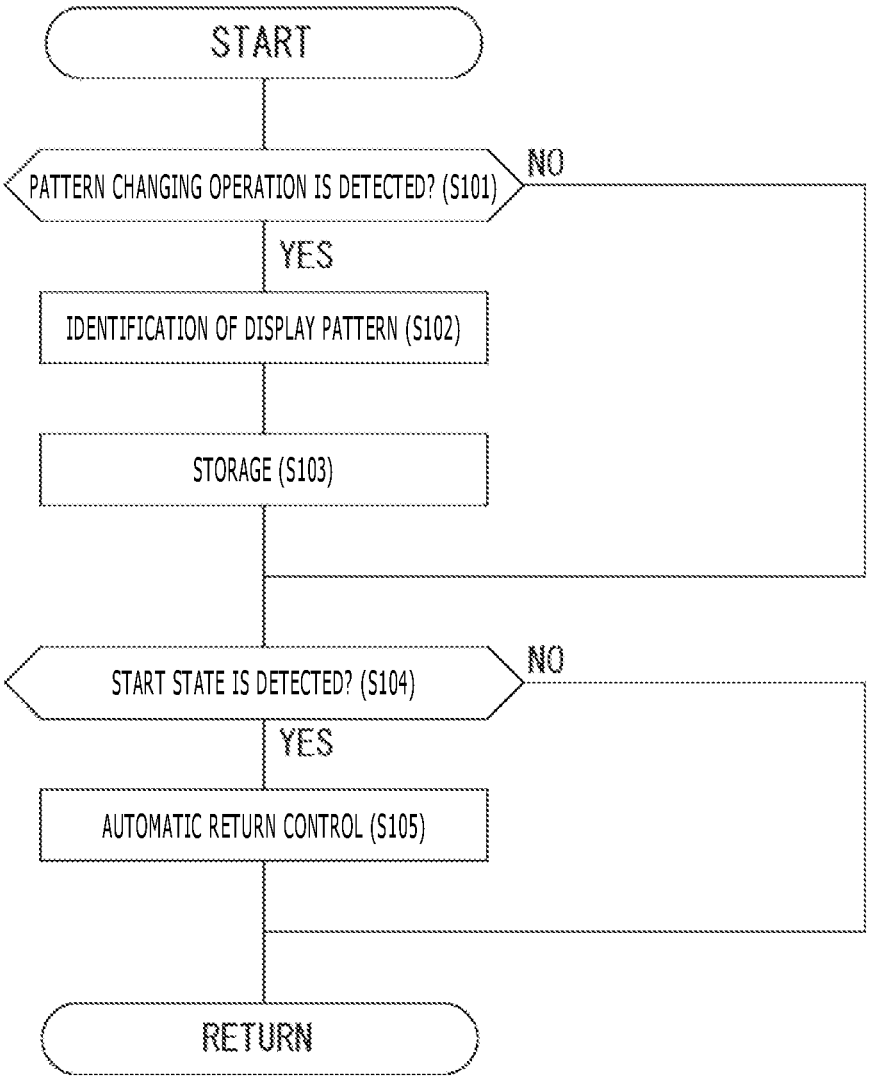
FIG. 8 is a flowchart showing a procedure of main processing of the controller.

FIG. 8 is a flowchart showing a procedure of main processing of the controller. With start of the processing by turning the power ON, the processing proceeds to a step S101. By the way, the current pattern being the display pattern at that point of time concerning the puzzle body 1*a* having been changed into the block shape is stored in the storage unit 51*a*.

In the step S101, a state of detection by each rotation sensor 46 is checked, and when confirmed that one pattern changing operation made by the player is detected, the processing proceeds to a step S102. In the step S102, the display pattern changed by the pattern changing operation detected in the step S101 is derived as the current pattern, and then, the processing proceeds to a step S103. Namely, the rotation sensor 46 and the storage unit 51*a* constitute a pattern identifying means for identifying the display pattern of the puzzle body 1*a* having been changed into the block shape.

In the step S103, the current pattern to be stored in the storage unit 51*a* is updated with the most current pattern derived from the past display pattern in the most recent step S102, while the latest operation history of the pattern changing operation detected in the most recent step S101 is stored in the storage unit 51*a* with time based on a relation with the past pattern changing operation, and then, the processing proceeds to a step S104.

Meanwhile, when confirmed in the step S101 that no pattern changing operation is detected, the processing proceeds to the step S104.

In the step S104, it is checked whether or not a predetermined start state is detected, and when confirmed that the predetermined start state is detected, the processing proceeds to a step S105, whereas when confirmed that no predetermined start state is detected, the processing is returned to the step S101. In the step S105, automatic return control is executed such that a display pattern of the cubic puzzle 1 (the puzzle body 1*a*) having been changed into the block shape with the display pattern other than the reference pattern displayed thereon is automatically changed to the reference pattern by one or more pattern changing operations with the motor 6, and then, the processing is returned to the step S101.

The start state refers to a state preliminarily prescribed in order to start the automatic return control and is capable of being arbitrarily set in matching with an interest and so on.

In this embodiment, a state to be set as the start state is such that the acceleration sensor 52 detects that the puzzle body 1*a* having been changed into the block shape with the display pattern other than the reference pattern displayed thereon stops its action on a predetermined place such as a horizontal plane and keeps a stably stationary condition. In other words, the start state in this embodiment means a state satisfying two conditions, that is, one condition that the puzzle body 1*a* is changed into the block shape with the current pattern displayed as the display pattern other than the reference pattern, and the other condition that the puzzle body 1*a* stops its action on the predetermined place such as the horizontal plane and keeps the stably stationary condition.

According to setting of the start state in this manner, such setting allows the rotation sensor 46, the storage unit 51*a* and the acceleration sensor 52 to function as a start state detecting means for detecting the start state.

Then, when detection of the start state in the step S104 is followed by the processing in a step S105 to start execution of the automatic return control, the current pattern being the display pattern at that point of time other than the reference pattern is read out from the storage unit 51*a*.

Then, the processing of derivation follows to derive one or more pattern changing operations required to change the puzzle body 1*a* changed into the block shape with the read-out current pattern displayed thereon is subjected to re-change to the puzzle body 1*a* changed into the block shape with the reference pattern displayed thereon. In this embodiment, either of the following two solutions is applied to a solution required for the processing of derivation.

One solution is use of a general solution in which each pattern changing operation is to be performed according to a procedure opposite to the procedure of and in a direction opposite (or by reversing the direction of rotation in each pattern changing operation) to one or more pattern changing operations required to change from the reference pattern to the current pattern, because the operation history of the one or more pattern changing operations is sequentially stored in the storage unit 51*a* with time as described the above. The other solution is use of a unique solution different from the general solution. This unique solution has been heretofore well known, and hence, its details will be omitted. It is, however, noted that according to the unique solution, it enables derivation of the display pattern from only the current pattern stored in the storage unit 51*a*, thereby eliminating the need to sequentially store the operation history of the one or more pattern changing operations in the storage unit 51*a* at every pattern changing operation detected by any one of the six rotation sensors 46.

After the processing to derive one or more pattern changing operations required to change from the current pattern to the reference pattern by using either the general solution or the unique solution, the thus derived one or more pattern changing operations are performed sequentially by the motor 6 and, upon completion of all the pattern changing operations, the automatic return control is finished.

By the way, when the pattern changing operation is performed by any one of the six motors 6 so that the drive side rotating unit 9B as the target of the pattern changing operation in the puzzle body 1*a* having been changed into the block shape is turned to a target position where the above drive side rotating unit 9B is advanced by quarter or approximately quarter turns in a first direction being one direction as the direction around any one of the rotation axes X, Y, Z, the drive side rotating unit 9B may sometimes bring about a state (a failure state) in which the drive side rotating unit 9B is caught by the pieces 3 of the other rotating unit 9 so that the turning operation of the drive side rotating unit 9B is regulated or stopped at a predetermined timing such as the point of time when starting the above turning operation.

This failure state is capable of being identified by a result of no detection of any turning motion of the drive side rotating unit 9B by the rotation sensor 46, even though the electric signal for turning the drive side rotating unit 9B as the target of the pattern changing operation is outputted to the motor 6-side.

The control unit 51 with the failure state detected by the rotation sensor 46 finishes the pattern changing operation with safety by the manner in which the drive side rotating unit 9B as the target of the pattern changing operation is returned in the first direction to the target position after being turned by the motor 6 by a predetermined amount in a second direction being a direction opposite to the first direction so that the rotating unit 9 causing the failure state is turned slightly in a direction opposite to a failure direction (see below) so as to be returned to its original position free from causing any failure state.

Meanwhile, the control unit 51 with the failure state detected by the rotation sensor 46 may finish the pattern changing operation with safety also by the manner in which the drive side rotating unit 9B as the target of the pattern changing operation is turned to the target position by the motor 6 by a predetermined amount (¾ or approximately ¾ turns, for instance) in the second direction being the direction opposite to the first direction.

By the way, although there is no occurrence of any failure state if the rotating unit 9 rotated centering around any one of the rotation axes X, Y, Z perpendicular to that of the drive side rotating unit 9B as the target of the pattern changing operation and having a part constituted of the same piece 3 as that of the drive side rotating unit 9B is turned to its original position, it is considered that displacement of the above rotating unit 9 by a predetermined amount or more in the failure direction being a predetermined direction causes the failure state.

For that reason, it is effective to perform a preliminary turning operation by which the above rotating unit 9 possibly causing the failure state of the drive side rotating unit 9B as the target of the pattern changing operation is turned slightly (by about less than 1 degree, for instance) in the direction opposite to the direction in which the failure state may occur, wherein when the above rotating unit 9 becomes the target of the pattern changing operation, it is allowable also to perform the preliminary turning operation at the same time as the pattern changing operation in order to prevent the failure state from occurring in the next or later pattern changing operations of the other rotating units 9. The preliminary turning operation results in no need of high accuracy as the accuracy required for the pattern changing operation by the motor 6, thus providing a great advantage.

It is noted that the controller may be also constituted so as to avoid the failure state by firstly turning the drive side rotating unit 9B as the target of the pattern changing operation in the second direction by the motor 6 without turning it in the first direction being the original direction, and thereafter following the same steps as those of the preliminary turning operation, when the rotation sensor 46 detects the rotating unit 9 possibly causing the failure state of the drive side rotating unit 9B as the target of the pattern changing operation.

According to the cubic puzzle 1 having the above constitution, such cubic puzzle 1 enables the automatic return control to be executed at an appropriate timing by means of intentionally producing an appropriately-set start state, even for the Rubik's cube having been considered to be difficult to have an operation tool such as a switch at its outside face side, thereby enabling a player to enjoy playing the cubic puzzle than before.

Further, for the cubic puzzle 1 made up of the Rubik's cube in which the failure state is likely to occur, the occurrence of the failure state is efficiently preventable by means of intentionally generating displacement and/or making the change of the turning operation to the first direction and to the second direction.

It is noted that the start state is not limited to that in the above embodiment. For instance, the start state may also include, as a part thereof, a state in which the rotation sensor 46 detects an operation by which any predetermined one of the rotating units 9 of the puzzle body 1*a* having been changed into the block shape is rotated ranging from once to several times and/or rotated by the same or approximately same amount as a predetermined amount in a direction opposite to one direction after being rotated by the predetermined amount in the one direction so as to bring about no change of the display pattern, instead of the state in which the acceleration sensor 52 detects the stably stop of the puzzle body 1*a*. In this case, the six rotation sensors 46 constitute a part of the start state detecting means, thereby allowing the acceleration sensor 52 to be omitted.

Alternatively, it is allowable also to define the plurality of types of turning or rotating operations as described the above of the rotating unit 9 having no need of changing the display pattern, thereby making the control turning unit 51 execute different control at every type of the turning or rotating operations. For instance, one type of turning or rotating operation is applied to execution of the automatic return control, while the other type of turning or rotating operation is made applicable to execution of control such that displaying of predetermined display contents (such as a sun-flag image, for instance) on one outside face of the block-shaped puzzle body is performed once or repeatedly over a plurality of times.

Alternatively, it is allowable also to detect by the acceleration sensor 52 that the puzzle body 1*a* having been changed into the block shape with the display pattern other than the reference pattern displayed thereon keeps a predetermined attitude (a raised attitude of the puzzle body 1*a* whose one corner piece 3A is located at a lower end side, with a sharp end side of the one corner piece 3A held by hand) for a certain period of time since a change of the attitude of the puzzle body to the predetermined attitude, thereby allowing the predetermined attitude of the puzzle body to be specified as a part of the start state, instead of the state in which the acceleration sensor 52 detects the stable stop of the puzzle body 1*a*.

By the way, a gyro sensor 53 for detecting the attitude of the puzzle body 1*a* may be also installed in a state of being connected to the input side of the control unit 51 as shown by a virtual line in FIG. 7. The gyro sensor 53 may also constitute a part of the attitude detecting means to thereby increase the accuracy of detection of the attitudes and/or gestures of the puzzle body 1*a*. For instance, various actions such as shaking the puzzle body with hand and/or moving the puzzle body so as to draw a predetermined trajectory are capable of being set as the gestures, wherein it is possible of course to set these gestures as the part or whole of the start state.

Further, a pattern identifying means 54 may be also installed at the input side of the control unit 51 as shown by a virtual line in FIG. 7. In the above embodiment, identification of the display pattern is performed at every pattern changing operation detected by the six rotation sensors 46, whereas a reading means such as a barcode reader, a camera and an IC tag reader for reading identification information such as one-dimensional or two-dimensional barcodes, color patterns and IC tags may also constitute the pattern identifying means 54 by imparting the identification information to the individual pieces 3, while installing the reading means at the core member 2-side.

Furthermore, an information terminal 56 may be also installed as shown by a virtual line in FIG. 7. The information terminal 56 has a control unit 56*a* for executing various processing, a storage unit 56*b* for storing various information, a touch panel type liquid crystal display 56*c* configuring an input/output interface, a camera 56*d* and a radio communication means 56*e*. Meanwhile, a radio communication means 57 enabling radio communication with the information terminal 56 is connected to the control unit 51 in an inputtable/outputtable manner.

With the above constitution, the information terminal 56 and the control unit 51 constitute at least a part of the controller (the whole of the controller in this embodiment), thereby enabling the processing heretofore executed by the control unit 51 to be partly or wholly executed by the high-performance control unit 56*a* of the information terminal 56.

Furthermore, the information terminal 56 and the radio communication means 57 may also constitute the pattern identifying means. More specifically, the current pattern being the display pattern at that point of time regarding the block-shaped puzzle body 1*a* may be also identified based on a plurality of external appearance image data of the block-shaped puzzle body 1*a* photographed by the camera 56*d* or the like of the information terminal 56. By the way, for identification of the display pattern of the puzzle body 1*a* having been changed into the block shape, the image data of the puzzle body 1*a* photographed from one angle thereof fails to implement such identification, resulting in the necessity of image data of the puzzle body 1*a* photographed from different angles thereof. It is noted that when the controller is in a situation where sight of the current pattern is lost due to battery run-out and so on, it is possible also to deal with such situation without use of the plurality of image data of the puzzle body 1*a* photographed from a plurality of angles thereof and/or use of the pattern identifying means 54. For instance, the controller may be made to recognize returning of the current pattern to the reference pattern by an informing means being a predetermined informing means, after the change of the display pattern to the reference pattern is made by a manual operation. This informing means is capable of providing various ways of setting such as to provide an informing operation as a predetermined operation detectable by the acceleration sensor 52 or alternatively, an informing operation performed by radio communication from the information terminal 56.

Further, the radio communication between the information terminal 56 and the control unit 51 enables the puzzle body 1*a* to be remotely controlled, and besides, the rotational driving of the drive side rotating unit 9B enables the puzzle body 1*a* to be moved in a linearly moving or turning manner to an intended position on the predetermined place such as the horizontal plane.

Next will be described the features different from those in the foregoing embodiment in relation to a different embodiment of the present invention with reference to FIGS. 7 to 9.

In this embodiment, the cubic puzzle 1 is capable of being provided with one or more modes in addition to the automatic return control execution mode.

Figure 9:
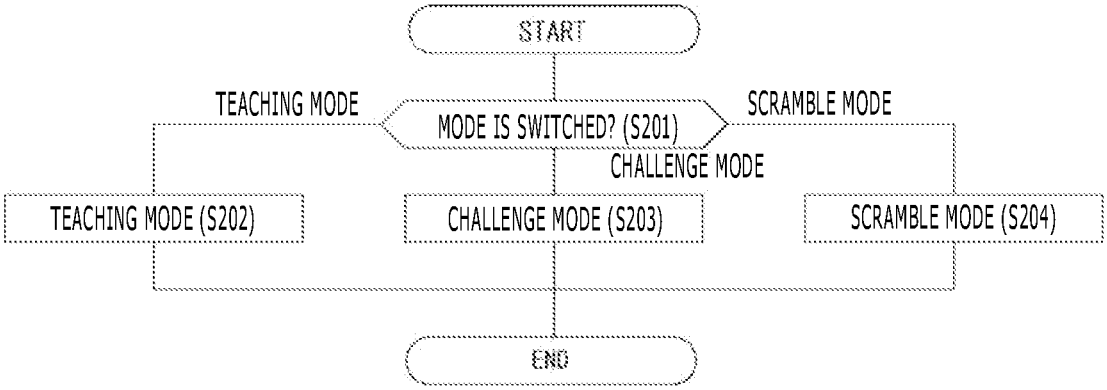
FIG. 9 is a flowchart showing a procedure of processing which is to be executed at every mode switching.

FIG. 9 is a flowchart showing a procedure of processing executed at every mode switching. The controller temporarily stops the main processing shown in FIG. 8 when mode switching is detected, followed by starting the processing shown in FIG. 9 to advance the processing to a step S201. By the way, the controller restarts the processing shown in FIG. 8 upon completion of a series of processing shown in FIG. 9.

By the way, mode switching is set as an operation free from overlapping with the operation regarding the start state. For instance, when making it one of the automatic return control conditions that the puzzle body 1*a* having been changed into the block shape is placed on a placement surface such as the horizontal plane such that a first outside face being one of the outside faces of the puzzle body 1*a* is in contact with the placement surface, mode selection is performed depending on which of second, third and fourth outside faces being the three outside faces other than the surface set as the first outside face of the puzzle body 1*a* would be faced to the placement surface side when placing the puzzle body 1*a* on the placement surface, wherein each of such mode selecting operations corresponds to the mode switching.

For instance, a teaching mode (see below) is regarded as being selected when the puzzle body 1*a* with the second outside face thereof faced to the placement surface side is placed on the placement surface, a challenge mode (see below) is regarded as being selected when the puzzle body 1*a* with the third outside face thereof faced to the placement surface side is placed on the placement surface, and a scramble mode (see below) is regarded as being selected when the puzzle body 1*a* with the fourth outside face thereof faced to the placement surface side is placed on the placement surface.

In the step S201, when the mode selected by the mode switching is the teaching mode, the processing proceeds to a step S202, when the mode selected by the mode switching is the challenge mode, the processing proceeds to a step S203, and when the mode selected by the mode switching is the scramble mode, the processing proceeds to a step S204.

In the step S202, the teaching mode is executed, and thereafter, the processing shown in FIG. 9 is also finished upon completion of the execution of the teaching mode. During the execution of the teaching mode, the controller executes updating of the display pattern to be stored in the storage unit 51*a* at every pattern changing operation and storing of the operation history of the pattern changing operation in the storage unit 51*a* in order of time series while enabling identification of the current pattern being the display pattern at that point of time, like the processing shown in FIG. 8.

When continuation of a state of no detection of any player's manual pattern changing operation by the rotation sensor 46 occurs for a fixed time or more, for instance, in the middle of the execution of the teaching mode, the controller executes the processing of derivation of one or more pattern changing operations required to change to the reference pattern according to the above solution to turn, by a predetermined amount of not more than quarter turns, the rotating unit 9 to be moved next, and followed by giving to the player such suggestion that the thus turned rotating unit 9 is to be operated. For more details about the teaching mode, the teaching mode makes it possible to learn how to solve the cubic puzzle 1 in stages. For instance, learning of a procedure of changing the display pattern to the reference pattern is made possible in stages so as to follow an operation sequence being first one of the drive side rotating units 9B, then the non-drive-side rotating unit 9A and finally the remaining drive-side rotating unit 9B, while the control unit 51 is constituted so as to make repetitive learning possible in each stage by performing, by the motor 6, the change of the display pattern of the puzzle body 1*a* to a teaching pattern being a display pattern made to correspond to a selected learning stage. Further, downloading of the teaching pattern from the internet and so on is also made possible by the information terminal 56. Furthermore, the information terminal 56 may be also made to display information of the pattern changing operation to be performed next, because the suggestion of the next pattern changing operation for the change from the current pattern is given to the player.

Then, the controller finishes the execution of the teaching mode upon completion of the change of the display pattern to the reference pattern. Further, the control unit may also bring back the process of reaching the reference pattern by appropriately driving the motor 6 at an arbitrary timing such as a finish time of the teaching mode, because the operation history of one or more pattern changing operations required to reach the reference pattern is stored in the storage unit 51*a* sequentially in order of time series by the above processing.

In the step S203, the challenge mode is executed, and thereafter, the processing shown in FIG. 9 is also finished upon completion of the execution of the challenge mode. During the execution of the challenge mode, the controller executes updating of the display pattern to be stored in the storage unit 51*a* at every pattern changing operation and storing of the operation history of the pattern changing operation in the storage unit 51*a* in order of time series while enabling identification of the current pattern being the display pattern at that point of time, like the processing shown in FIG. 8.

The controller is constituted so as to make a timer of the controller measure a time required to change to the reference pattern by one or more pattern changing operations manually made by the player in the middle of the execution of the challenge mode. Upon completion of the change of the display pattern to the reference pattern, the controller finishes the execution of the challenge mode after informing the player about a play time being the time required until then through a speaker 58 provided on the output side of the control unit 51 so as to be arranged at the core member 2-side. By the way, the controller may also bring back the process of reaching the reference pattern by appropriately driving the motor 6 at an arbitrary timing such as a finish time of the challenge mode, because the operation history of one or more pattern changing operations required to reach the reference pattern is stored in the storage unit 51*a* sequentially in order of time series, like the processing in the teaching mode.

Further, setting of a time limit which imposes limitation on the play time is also possible. In this case, the controller informs the player about the time limit through the speaker 58 at the time when switching to the challenge mode is made, and further gives to the player the information about the residual time through the speaker 58 and/or by screen display of the information terminal 56 or the like during playing. When the change of the display pattern to the reference pattern could not be completed within the time limit, the controller finishes the execution of the challenge mode after informing by the same means as the above to the player that the challenge mode results in failure.

It is noted that during the execution of the challenge mode, a lapse of the time limit may be also informed to the player by vibrating the puzzle body 1*a* with a vibration motor (a vibrating means) 59 connected to the output side of the control unit 51 so as to be arranged at the core member 2-side.

Further, according to this vibration motor 59, it enables various conditions other than the lapse of the time limit to be also reported in such a manner as to vary an interval and/or length of vibrations.

Further, the lapse of the time limit may be also informed to the player by the manner in which the controller executes one or more randomly or arbitrarily selected pattern changing operations to change the display pattern. Furthermore, whenever a predetermined time has elapsed in the middle of playing by the player after switching to the challenge mode, the controller may also execute one or more randomly or arbitrarily selected pattern changing operations to interfere with the change to the reference pattern in order to increase a difficulty level, thereby allowing the entertainment property to be improved. By the way, a change of difficulty level is easily made by increasing/decreasing the number of times of execution of the arbitrary pattern changing operations to be executed whenever the predetermined time has elapsed.

In the step S204, the scramble mode is executed, and thereafter, the processing shown in FIG. 9 is also finished upon completion of the execution of the scramble mode. During the execution of the scramble mode, the controller executes updating of the display pattern to be stored in the storage unit 51*a* at every pattern changing operation and storing of the operation history of the pattern changing operation in the storage unit 51*a* in order of time series, while enabling identification of the current pattern being the display pattern at that point of time, like the processing shown in FIG. 8. With start of the execution of the scramble mode, the controller executes one or more randomly or arbitrarily selected pattern changing operations to change the display pattern, and thereafter finishes the execution of the challenge mode upon completion of the change of the display pattern.

It is noted that the acceleration sensor 52 or both the acceleration sensor 52 and the gyro sensor 53 are capable of detecting such player's actions as shaking the puzzle body 1*a* with hand and/or player's gestures of drawing characters such as L-letter in the air and so on, wherein these gestures may be also individually assigned to the operations of switching to the teaching mode, the challenge mode and the scramble mode, or alternatively, specified as the part of the start state.

Next will be described the features different from those in the foregoing embodiment in relation to a further different embodiment of the present invention with reference to FIGS. 10 to 12.

Figure 10:
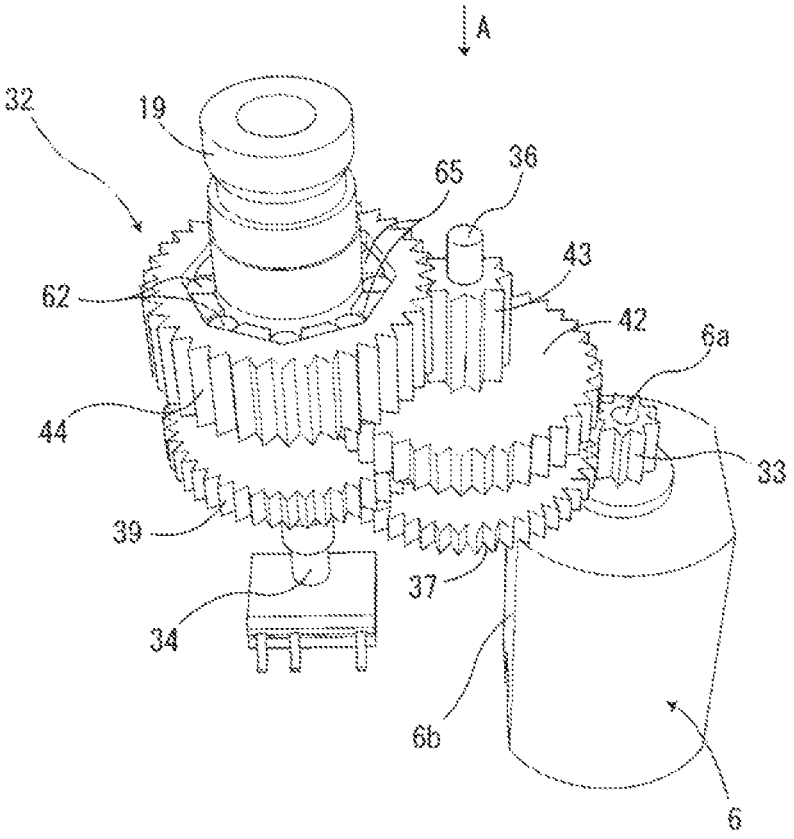
FIG. 10 is a perspective view showing a transmission mechanism according to a different embodiment of the present invention.
Figure 11:
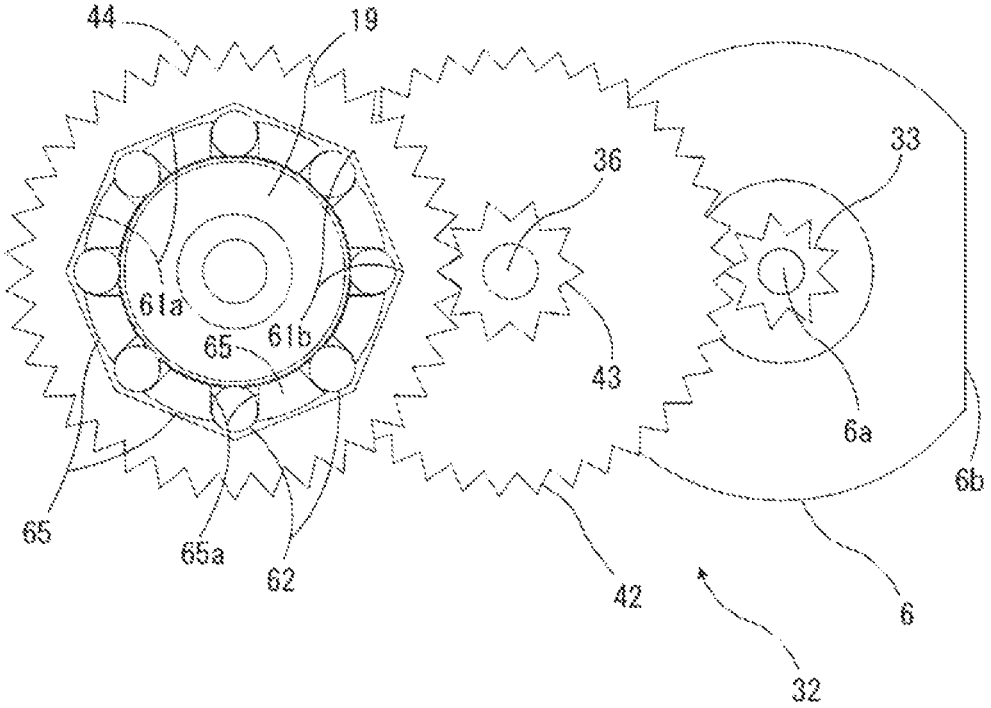
FIG. 11 is a view from a direction indicated by arrow A in FIG. 10.
Figure 12:
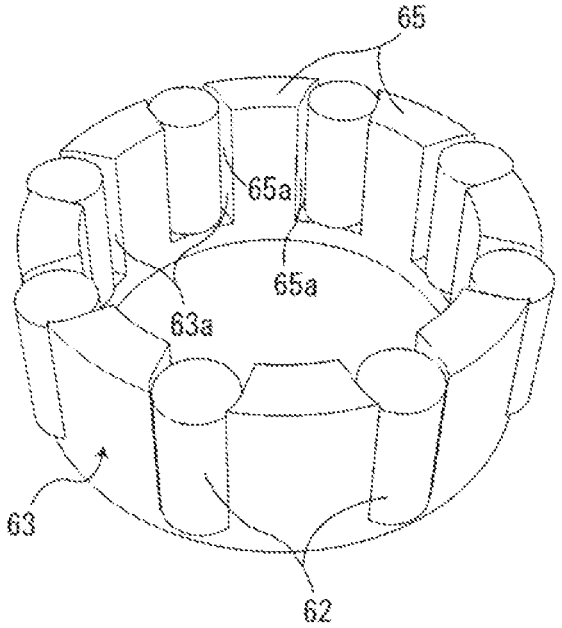
FIG. 12 is a perspective view showing a roller and a roller holding member, each of which constitutes a part of a clutch mechanism.

FIG. 10 is a perspective view showing a transmission mechanism according to a further different embodiment of the present invention, FIG. 11 is a view as viewed from a direction shown by arrow A in FIG. 10, and FIG. 12 is a perspective view showing a roller and a roller holding member, each of which constitutes a part of a clutch mechanism. A transmission mechanism 32 shown in these FIGURES is provided with a clutch mechanism constituted so as to permit rotational driving force to be transmitted from the motor 6 to the rotating units 9, while preventing an operation amount obtained when manually rotating the rotating unit (the center piece 3C) by the player from being transmitted to the motor 6. This clutch mechanism provides advantages of being capable of suppressing the wear or damages of the transmission mechanism 32, in addition to enhancement of operability resulting from a reduction in operation load at the time of manually rotating or turning the rotating units 9 by the player.

The clutch mechanism is installed between an outer peripheral face of the drive shaft 19 and an inner peripheral face of the gear 44. When the drive shaft 19 is rotated, the clutch mechanism causes no transmission of the rotating operation force thereof to the gear 44 so that the gear 44 is held in a stopped state, whereas when the gear 44 is rotated, the clutch mechanism permits the rotational driving force thereof to be transmitted to the drive shaft 19 so that the drive haft 19 is rotationally driven.

Next will be described the constitution of the clutch mechanism. The drive shaft 19 has an outer peripheral face formed in a circular shape centered on the shaft center of the drive shaft 19 as viewed in the axial direction. The gear 44 has an inner peripheral face formed in a regular polygonal shape centered on the shaft center of the drive shaft 19 as viewed in the axial direction of the drive shaft 19. Because of the inner peripheral face shape of the gear 44, the inner peripheral face of the gear 44 is constituted of a plurality of contact faces 61*a* being flat faces and a plurality of corner parts 61*b* each formed at a portion where the mutually adjacent contact faces 61*a*, 61*a* are in contact with each other.

Between the inner peripheral face of the gear 44 and the outer peripheral face of the drive shaft 19, there are provided a plurality of rollers 62 rotatably arranged side by side in an annular shape circumferentially around the drive shaft 19. The number of rollers 62 is set to be the same as the number (eight, in the illustrated embodiment) of the corner parts 61*b* (the contact faces 61*a*) of the inner peripheral face of the gear 44.

Each roller holding part 65 of a roller holding member 63 for holding the rollers 62 is arranged between the mutually adjacent rollers 62, 62. The roller holding member 63 is formed in a circular ring-like shape so as to conform to the outer peripheral face of the drive shaft 19 and the inner peripheral face of the gear 44 as viewed in the axial direction of the drive shaft 19, and has recess parts 63*a* into which the rollers 62 are respectively received in an idling state, the recess parts being spaced at predetermined intervals. The roller holding member 63 is configured such that each of mutually adjacent portions across each recess part 63*a* forms each holding part 65. In other words, the recess parts 63*a* and the holding parts 65 being respectively equal in number to the rollers 62 are annularly arranged in turns at predetermined intervals in a space between the outer peripheral face of the drive shaft 19 and the inner peripheral face of the gear 44.

Each holding part 65 has, at both circumferential end sides thereof, inclined faces 65*a*, 65*a* each inclined such that a length of the inner peripheral face of the each holding part 65 is shorter than a length of the outer peripheral face thereof. Each recess part 63*a* forming a space between the mutually adjacent holding parts 65, 65 gets gradually narrow in width toward the side away from the shaft center of the drive shaft 19 due to the inclined faces 65*a*, 65*a*.

Each roller 62 partly protrudes toward the inner peripheral face of the gear 44 more than the outer peripheral face of each holding part 65. When each roller 62 is located at the corner part 44*b*-side in the inner peripheral face of the gear 44, a slight gap is made between the each roller 62 and the inner peripheral face of the gear 44, resulting in a state where idling of the each roller 62 is made possible. Meanwhile, when each roller 62 is located at the contact face 44*a*-side in the inner peripheral face of the gear 44, contact of the each roller 62 with the inner peripheral face of the gear 44 is made, resulting in a state where rotation of the each roller is regulated.

The clutch mechanism is constituted of the outer peripheral face of the drive shaft 19, the inner peripheral face of the gear 44, the plurality of rollers 62 and one roller holding member 63.

When the drive shaft 19 is manually operated for rotation by the player, the outer peripheral face of the drive shaft 19 provides an idling operation to each roller 62 while making sliding on the inner peripheral face of the roller holding member 63, resulting in no transmission of any rotational power to the gear 44-side. Meanwhile, when the rotational power transmitted from the motor 6 is applied to the gear 44 to rotate the gear 44, each contact face 61*a* on the inner peripheral face of the gear 44 is pressed toward the outer peripheral face of the drive shaft 19 in a state where the each contact face makes contact with each roller 62 such that the rotation of the each roller is regulated, thereby allowing the rotational power of the gear 44 to be transmitted to the drive shaft 19 to rotationally drive the drive shaft 19.

Next will be described the features different from those in the foregoing embodiment in relation to a further different embodiment of the present invention with reference to FIG. 13.

Figure 13:
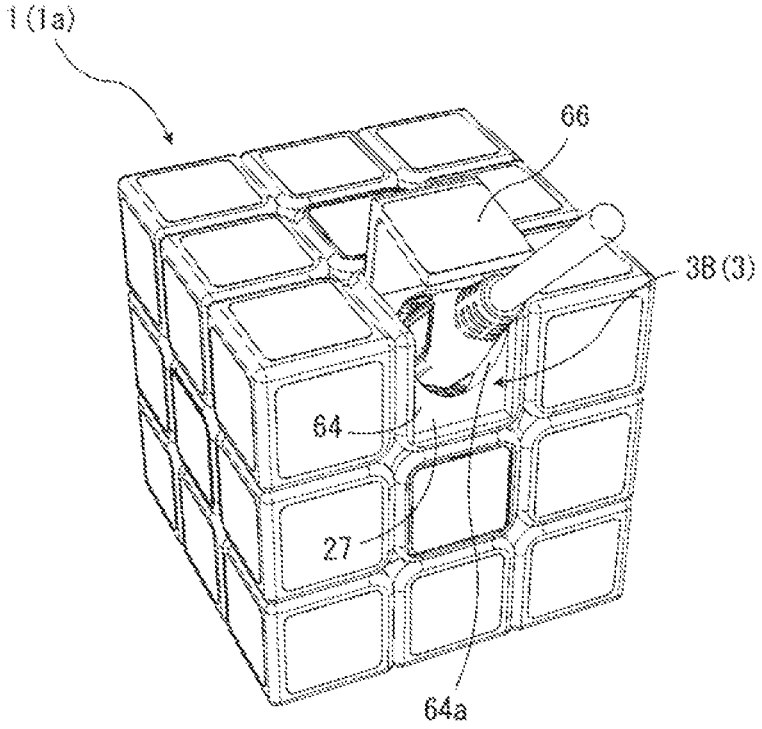
FIG. 13 is a perspective view showing a cubic puzzle according to a further different embodiment of the present invention.

FIG. 13 is a perspective view showing a cubic puzzle according to a further different embodiment of the present invention. In the foregoing embodiment, the connector for connection with the external power supply is installed at the center piece 3C-side, whereas in this embodiment, there is provided the connector installed at the inside of one edge piece 3B (more specifically, at a portion near the one edge piece 3B in the outside face of the core member 2).

For more details, the body part 27 of the one edge piece 3B has a fixing part 64 and an angular cover member 66 having two facets 8 and swingably supported to the fixing part. When the cover member 66 is opened in a direction of separating from the fixing member 64 to expose the fixing member 64 to the outside, an external access to a connector (not shown) provided at the core member 2-side is made possible through an access hole 64*a* formed in the fixing member 64, thereby enabling the supply of power from the external power supply. Meanwhile, when the cover member 66 is closed toward the fixing part 64-side by a swinging motion, a usual condition of functioning as the edge piece 3B is obtained.

Next will be described the features different from those in the foregoing embodiment in relation to a further different embodiment of the present invention with reference to FIGS. 7 and 14.

Figure 14:
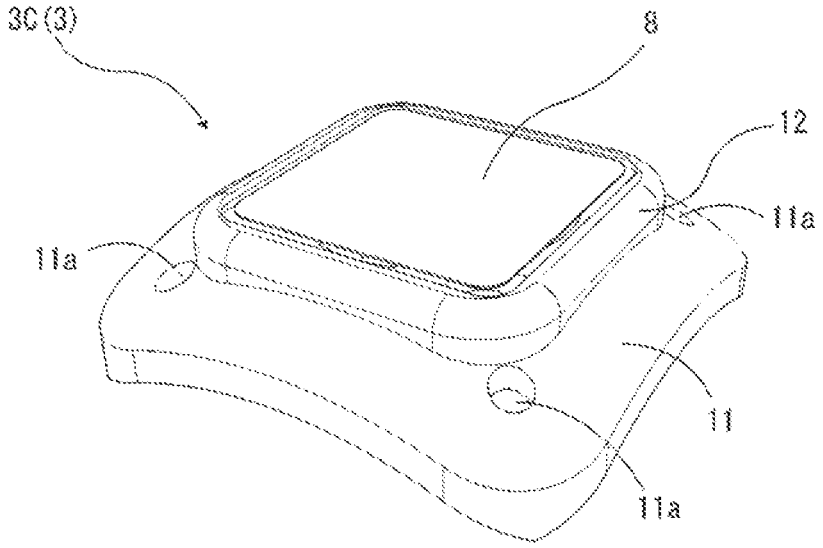
FIG. 14 is a perspective view showing a center piece according to a further different embodiment of the present invention.

FIG. 14 is a perspective view showing a center piece according to a further different embodiment of the present invention. The engagement part 11 of the center piece 3C has an exposure hole 11*a* through which a core member 2-side portion is exposed to the outside. The exposure hole 11*a* is in the form of a round hole formed in a portion close to each of four corners of the body part 12 and is located at a position free from being covered with the body parts 24, 27 of the pieces 3 adjacent to this center piece 3C.

Further, a LED 60 (see FIG. 7) being a light source installed at the core member 2-side may be also exposed to the outside through each exposure hole 11*a*. This enables various conditions to be informed to the player and/or an owner of the cubic puzzle with the presence/absence of light emission from the LED 60 and/or the change of color of emitted light. For instance, it is possible to inform the player of the completion or not of charging when performing a charging operation, with the presence/absence of light emission from the light source, the change of a light-emitting pattern and/or the change of the color of emitted light.

Further, an external access to the power supply connector at the core member 2-side is also made possible by utilizing each exposure hole 11*a*. In other words, it is possible also to charge the cubic puzzle 1 by utilization of each exposure hole 11*a*.

Next will be described the features different from those in the foregoing embodiment in relation to a further different embodiment of the present invention with reference to FIG. 15.

Figure 15:
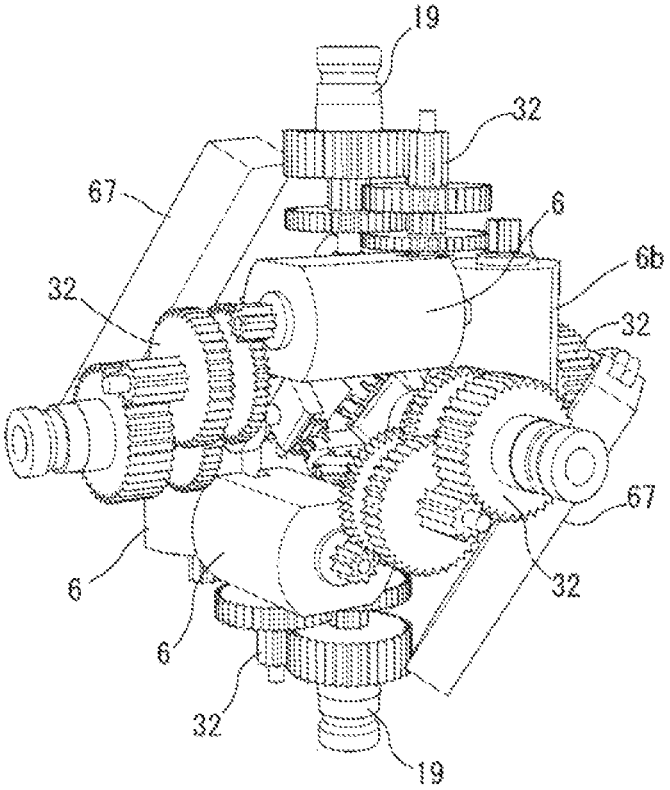
FIG. 15 is a perspective view showing the arrangement configuration of batteries.

FIG. 15 is a perspective view showing the arrangement configuration of batteries. In the foregoing embodiment, the single battery is installed as an internal power supply at a side opposite to the control substrate 47 in the outside face side of the core member 2, whereas in this embodiment, there are provided two rechargeable batteries 67, 67 respectively arranged at symmetrical positions with respect to the core member 2. Such arrangement of the batteries 67 is obtained by making use of a space which is made resulting from inclining the cutout face 6*b* of the motor 6 toward the outside face.

More specifically, each battery 67 is arranged in a well fitted state in a posture inclined from the cutout face 6*b* of the motor 6 toward the drive shaft 19 which is at the side opposite to and coaxial with the drive shaft 19 to which the rotational driving force is transmitted from the motor 6.

Next will be described the features different from those in the foregoing embodiment in relation to a further different embodiment of the present invention with reference to FIG. 16.

Figure 16:
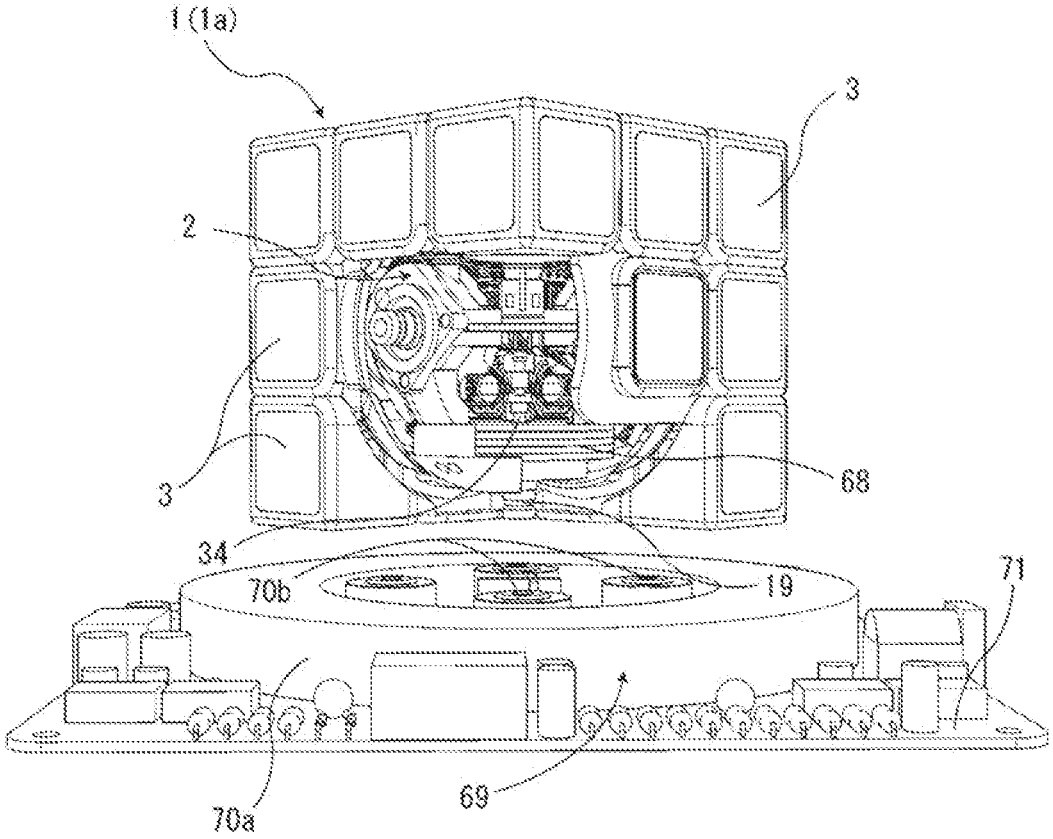
FIG. 16 is a perspective view showing the constitution of a further different embodiment of the present invention.

FIG. 16 is a perspective view showing the constitution of a further different embodiment of the present invention. The inventor of the present application has found out that the cubic puzzle 1 made up of the type of 3×3×3 Rubik's cube is capable of changing from the arbitrary display pattern to the reference pattern without rotating any one of the drive side rotating units 9B and hence, this embodiment relates to a constitution obtained by making use of the above findings. More specifically, both the unitizing part 28 and the transmission mechanism 32 other than the motor 6 and the drive shaft 19 respectively provided for the one drive side rotating unit 9B are omitted to reduce the number of components. The drive shaft 19 is rotatably supported to the core member 2-side by the support shaft 34 and is capable of being manually rotated or turned by the player, wherein the manual rotation or turning motion thereof is detectable by the rotation sensor 46.

Further, a disk-shaped magnet 68 may be also fixedly mounted through the support shaft 34 to a space which is made resulting from omitting the transmission mechanism and the unitizing part. Meanwhile, there is provided a magnetically floating unit 69 separately from the puzzle body 1*a*. The magnetically floating unit 69 has a single circular ring-shaped permanent magnet 70*a* mounted on a substrate 71 or a plurality of permanent magnets 70*a* annularly arranged side by side (the former is shown in the illustrated embodiment) and one or more (four, in the illustrated embodiment) electromagnets 70*b* located at positions close to the center of a ring-shaped portion of the permanent magnet 70*a*, and is arranged just below the puzzle body 1*a*.

Then, floating force is applied to the puzzle body 1*a* by a repulsion action between a magnetic field constantly generated from the permanent magnet 70*a* and a magnetic field constantly generated from the magnet 68, while control of a plane position of the puzzle body 1*a* is performed by the magnetic field generated from the electromagnet 70*b*. By so doing, it becomes possible to float the puzzle body 1*a* just above the magnetically floating unit 69. If each rotating unit 9 of the cubic puzzle 1 is rotationally driven by the motor 6 in such floating state of the puzzle body, an improved entertainment property is obtained.

It is noted that it is possible of course to provide the magnetically floating unit 69 in a state where all the six drive side rotating units 9B are made drivable for rotation, and in this case, it is possible to deal with by miniaturizing each component, or alternatively, by enlarging the cubic puzzle 1.

Next will be described the features different from the foregoing embodiment in relation to a further different embodiment of the present invention with reference to FIG. 17.

Figure 17:
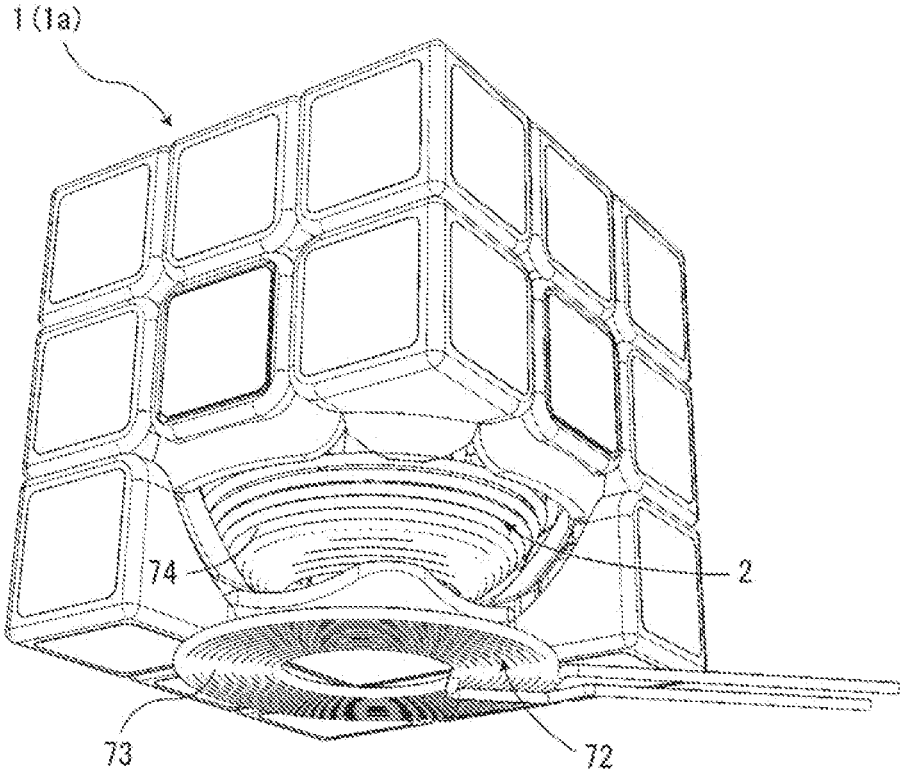
FIG. 17 is a perspective view showing the constitution of a further different embodiment of the present invention.

FIG. 17 is a perspective view showing the constitution of a further different embodiment of the present invention. In this embodiment, the supply of power to the illustrated cubic puzzle 1 is performed by a wireless charging device 72. The wireless charging device 72 has a power transmission coil 73 driven by an external power supply, a power receiving coil 74 provided at the core member 2-side, and a rectification circuit for rectifying AC voltage generated by electromagnetic induction caused by the power transmission coil 73 and the power receiving coil 74 into DC voltage for charging the battery (not shown).

Then, the AC voltage generated at the power receiving coil 72-side by electromagnetic induction is converted into the DC voltage by the rectification circuit so that charging is made on the battery.

EXPLANATION OF REFERENCE NUMERALS

1: Cubic puzzle
1*a*: Puzzle body
2: Core member
4: Support mechanism
3: Piece
3A: Corner piece
3B: Edge piece
3C: Center piece
6: Motor (Actuator)
8: Facet
9: Rotating unit
46: Rotation sensor
51: Control unit
51*a*: Storage unit
52: Acceleration sensor (Acceleration detecting means, attitude detecting means)
54: Pattern identifying means
56: Information terminal
57: Radio communication means
X: Rotation axis
Y: Rotation axis
Z: Rotation axis

The invention claimed is:

1. A cubic puzzle capable of changing its entire body into a cubic block shape with a plurality of pieces, the cubic puzzle comprising:

a core member arranged at a center side of the cubic puzzle;

the plurality of pieces each having a square facet configuring a part of six outside faces formed resulting from change into the block shape, said pieces being arranged side by side so as to cover the whole or approximately whole circumference of said core member, while being in a state where a grid-like pattern displayed on each outside face is obtained with a plurality of facets;

a support mechanism for supporting said plurality of pieces to said core member so that said pieces are rotatable centering around three rotation axes being three virtual linear axes perpendicularly or approximately perpendicularly intersecting one another at the center of said core member; and a controller including an actuator for rotationally driving said pieces and performing control of the actuator;

wherein a rotating unit including said plurality of pieces arranged in a square annular shape circumferentially around each rotation axis is constituted so as to be integrally rotated centering around the each rotation axis;

each of the three rotation axes is provided with a plurality of rotating units which are mutually the same in number and are arranged side by side in the axial direction of the each rotation axis;

a puzzle body including said core member, said pieces and said support mechanism is constituted so as to be subjected to change into the block shape by turning all the rotating units arranged in the axial direction of any one of the rotation axes so as to bring them into a state of being completely or approximately completely overlapped one another in the axial direction of the one rotation axis;

said puzzle body being constituted so as to, at every pattern changing operation by which said puzzle body in a state of being changed into the block shape is subjected to re-change into the block shape by turning any one of the rotating units in said puzzle body in one direction centering around any one of the rotation axes, allow a combination of the plurality of pieces constituting the other rotating units rotated centering around the rotation axes other than the one rotation axis to be changed;

each facet has a predetermined character, color or pattern, or alternatively, a combination thereof which is displayed in a fixed fashion thereon so as to allow a part of a display pattern composed of display contents on the six outside faces of said puzzle body having been changed into said block shape to be changed at every pattern changing operation;

said controller includes a pattern identifying means for identifying said display pattern and a start state detecting means for detecting a predetermined start state; and said controller is constituted so as to automatically change the display pattern to a reference pattern being a predetermined reference display pattern, making it a minimum condition that a current pattern being a display pattern at that point of time when identified by said pattern identifying means is different from the reference pattern, while said start state detecting means detects said predetermined start state.

2. The cubic puzzle according to claim 1, wherein said pattern identifying means includes a rotation sensor for detecting rotation of said rotating units, and a storage unit installed in said controller, wherein said controller is constituted so as to, whenever said rotation sensor detects one pattern changing operation, store the display pattern updated by the detected one pattern changing operation in the storage unit.

3. The cubic puzzle according to claim 2, wherein said controller is constituted so as to derive one or more pattern changing operations required to change from a current pattern being a display pattern at the point of time when stored in the storage unit to said reference pattern according to a unique solution different from a general solution in which each pattern changing operation is to be performed according to a procedure opposite to the procedure of and in a direction opposite to the direction of the plurality of pattern changing operations required to change from said reference pattern to said current pattern.

4. The cubic puzzle according to claim 1, wherein said start state detecting means includes an acceleration sensor for detecting action of the puzzle body, wherein said controller is constituted so as to determine that said start state is detected, making it at least a condition that said acceleration sensor detects that said puzzle body is placed on a predetermined place and keeps a stably stationary condition.

5. The cubic puzzle according to claim 1, wherein said start state detecting means includes an attitude detecting means for detecting attitude of said core member, wherein said controller is constituted so as to determine that said start state is detected, when said attitude detecting means detects that the attitude of said core member is changed to a predetermined attitude.

6. The cubic puzzle according to claim 1, wherein the cubic puzzle further comprises a rotation sensor for detecting rotation of said rotating units, wherein said controller is constituted so as to change a rotating unit position to a target position being a predetermined turning position by driving the rotating unit for turning by a predetermined amount in a second direction being a direction opposite to a first direction being one direction, followed by driving the thus turned rotating unit for turning in said first direction, or alternatively, by driving said rotating unit for turning in the second direction being a turning direction opposite to the first direction, when said rotation sensor detects a state in which the turning motion of the rotating unit is stopped or regulated, in the middle of an operation by which the rotating unit position is changed to said target position by driving the rotating unit for turning in the first direction.

7. The cubic puzzle according to claim 1, wherein the cubic puzzle further comprises a rotation sensor for detecting rotation of said rotating units, wherein said controller is constituted so as to perform a preliminarily turning operation by which the rotating unit which is other than the rotating unit to be turned and possibly causes a failure state for bringing about stop or regulation of the turning motion of the rotating unit to be turned is turned by a predetermined amount in a direction opposite to a direction in which the failure state may occur, when performing turning of the rotating unit to be turned.

8. The cubic puzzle according to claim 1, wherein the cubic puzzle further comprises a clutch mechanism for disconnecting power transmission so as to prevent manual operation force from said rotating units from being transmitted to said actuator, while permitting power transmission from said actuator to said rotating units.

9. The cubic puzzle according to claim 1, wherein said controller includes a control unit installed inside of said puzzle body and a radio-communicable information terminal arranged outside of said puzzle body separately from both the puzzle body and the control unit, and is provided with a radio communication means enabling radio communication between said control unit and said information terminal.

10. The cubic puzzle according to claim 9, wherein said pattern identifying means includes said radio communication means and said information terminal, wherein said controller is constituted so as to identify said current pattern based on image data of a photographed image of said puzzle body which is in the state of being changed into said block shape.

* * * * *